US008877011B2

(12) United States Patent
Guimond et al.

(10) Patent No.: US 8,877,011 B2
(45) Date of Patent: Nov. 4, 2014

(54) SYSTEMS AND METHODS FOR MAKING FIBER WEBS

(75) Inventors: Douglas M. Guimond, Pepperell, MA (US); Mark S. Millar, Bolton, MA (US); David Vallery, Exeter, NH (US); Milind Godsay, Nashua, NH (US)

(73) Assignee: Hollingsworth & Vose Company, East Walpole, MA (US)

( * ) Notice: Subject to any disclaimer, the term of this patent is extended or adjusted under 35 U.S.C. 154(b) by 220 days.

(21) Appl. No.: 13/469,352

(22) Filed: May 11, 2012

(65) Prior Publication Data

US 2013/0009335 A1 Jan. 10, 2013

Related U.S. Application Data

(60) Provisional application No. 61/484,733, filed on May 11, 2011, provisional application No. 61/484,736, filed on May 11, 2011, provisional application No. 61/484,737, filed on May 11, 2011, provisional application No. 61/484,743, filed on May 11, 2011, provisional application No. 61/484,750, filed on May 11, 2011, provisional application No. 61/484,754, filed on May 11, 2011.

(51) Int. Cl.
*D21F 1/00* (2006.01)

(52) U.S. Cl.
USPC ..... 162/210

(58) Field of Classification Search
USPC ..... 162/210, 198, 343, 129, 123, 156, 298; 264/172.14; 425/131.1
See application file for complete search history.

(56) References Cited

U.S. PATENT DOCUMENTS

| | | | | |
|---|---|---|---|---|
| 4,238,280 | A | 12/1980 | Chamberlain et al. | |
| 4,793,923 | A | 12/1988 | Kadoya et al. | |
| 4,888,094 | A | 12/1989 | Weisshuhn et al. | |
| 4,931,357 | A | 6/1990 | Marshall et al. | |
| 4,983,193 | A | 1/1991 | Tani et al. | |
| 5,011,573 | A | 4/1991 | Niemi | |
| 5,011,575 | A | 4/1991 | Keller | |
| 5,064,502 | A | 11/1991 | Turner | |
| 5,298,126 | A | 3/1994 | Dahl | |
| 5,580,459 | A | 12/1996 | Powers et al. | |
| 5,622,603 | A * | 4/1997 | Begemann et al. | 162/343 |
| 5,639,352 | A | 6/1997 | Heinzmann | |
| 5,645,689 | A | 7/1997 | Ruf et al. | |
| 5,672,399 | A | 9/1997 | Kahlbaugh et al. | |
| 5,674,364 | A | 10/1997 | Pitkajarvi | |
| 5,785,725 | A | 7/1998 | Cusick et al. | |
| 6,019,809 | A | 2/2000 | Kahlbaugh et al. | |
| 6,059,929 | A | 5/2000 | Dahl | |
| 6,099,692 | A | 8/2000 | Weisshuhn et al. | |
| 6,171,684 | B1 | 1/2001 | Kahlbaugh et al. | |
| 6,190,735 | B1 | 2/2001 | Radwanski et al. | |
| 6,251,225 | B1 | 6/2001 | Ruf et al. | |
| 6,410,465 | B1 | 6/2002 | Lim et al. | |
| 6,761,801 | B2 * | 7/2004 | Ruf et al. | 162/336 |
| 6,764,566 | B1 | 7/2004 | Griesbach et al. | |
| 7,008,465 | B2 | 3/2006 | Graham et al. | |
| 7,081,560 | B1 | 7/2006 | Lim et al. | |
| 7,137,510 | B1 | 11/2006 | Klein et al. | |
| 7,314,497 | B2 | 1/2008 | Kahlbaugh et al. | |
| 7,794,571 | B2 * | 9/2010 | Lepomaki et al. | 162/343 |
| 8,021,455 | B2 | 9/2011 | Adamek et al. | |
| 8,267,681 | B2 | 9/2012 | Gupta et al. | |
| 2002/0060040 | A1 | 5/2002 | Rulis et al. | |
| 2002/0153113 | A1 | 10/2002 | Ruf et al. | |
| 2003/0032350 | A1 | 2/2003 | Kajander et al. | |
| 2003/0056918 | A1 | 3/2003 | Hamalainen et al. | |
| 2003/0159790 | A1 | 8/2003 | Ruf et al. | |
| 2004/0118765 | A1 | 6/2004 | Yavorsky et al. | |
| 2004/0170813 | A1 | 9/2004 | Digiacomantonio et al. | |
| 2005/0034827 | A1 | 2/2005 | Soderberg | |
| 2005/0124250 | A1 | 6/2005 | Wilson et al. | |
| 2007/0012414 | A1 | 1/2007 | Kajander et al. | |
| 2007/0029060 | A1 | 2/2007 | Murray et al. | |
| 2007/0220852 | A1 | 9/2007 | Lifshutz et al. | |
| 2007/0295468 | A1 | 12/2007 | Wildfong et al. | |
| 2008/0093042 | A1 | 4/2008 | Skoog et al. | |
| 2008/0110588 | A1 | 5/2008 | Lepomaki et al. | |

(Continued)

FOREIGN PATENT DOCUMENTS

DE 4329810 A1 6/1994

OTHER PUBLICATIONS

DE 10 2009 027 079.5, Ruf et al., Jun. 2009.*
International Preliminary Report on Patentability for PCT/US2012/037534 mailed on Nov. 21, 2013.
International Preliminary Report on Patentability for PCT/US2012/48291 mailed on Feb. 6, 2014.
International Preliminary Report on Patentability for PCT/US2012/48301 mailed on Feb. 6, 2014.
International Search Report and Written Opinion for PCT/US2012/037534 mailed on Jul. 27, 2012.
International Search Report and Written Opinion for PCT/US2012/48291 mailed on Sep. 20, 2012.
International Search Report and Written Opinion for PCT/US2012/48301 mailed on Sep. 20, 2012.

*Primary Examiner* — Mark Halpern
(74) *Attorney, Agent, or Firm* — Wolf, Greenfield & Sacks, P.C.

(57) ABSTRACT

Systems and methods for forming fiber webs, including those suitable for use as filter media and battery separators, are provided. In some embodiments, the systems and methods may involve the use of one or more fiber mixtures to form a fiber web. The fiber mixtures may flow in different portions of a system for forming a fiber web that may be separated by a lamella, and may join at a fiber web forming zone to produce a fiber web having multiple layers. The amount of mixing of the fiber mixtures at or near the fiber web forming zone may be controlled to produce fiber webs having different structural and/or performance characteristics. In some embodiments, the systems and methods described herein can be used to form fiber webs having a gradient in a property across a portion of, or the entire, thickness of the fiber web.

40 Claims, 14 Drawing Sheets

(56) References Cited

U.S. PATENT DOCUMENTS

| | | | | |
|---|---|---|---|---|
| 2009/0020251 | A1 | 1/2009 | Soderberg | |
| 2010/0187171 | A1 | 7/2010 | Gupta | |
| 2010/0187712 | A1 | 7/2010 | Gupta et al. | |
| 2010/0319543 | A1 | 12/2010 | Witsch et al. | |
| 2012/0138251 | A1 * | 6/2012 | Ruf et al. | 162/343 |
| 2012/0193056 | A1 | 8/2012 | Gupta et al. | |
| 2012/0312487 | A1 | 12/2012 | Guimond et al. | |
| 2013/0025806 | A1 | 1/2013 | Vallery | |
| 2013/0025809 | A1 | 1/2013 | Godsay et al. | |

* cited by examiner

SYSTEMS AND METHODS FOR MAKING FIBER WEBS

RELATED APPLICATIONS

This Application claims priority to U.S. Provisional Application No. 61/484,733, filed May 11, 2011, U.S. Provisional Application No. 61/484,736, filed May 11, 2011, U.S. Provisional Application No. 61/484,737, filed May 11, 2011, U.S. Provisional Application No. 61/484,743, filed May 11, 2011, U.S. Provisional Application No. 61/484,750, filed May 11, 2011, and U.S. Provisional Application No. 61/484,754, filed May 11, 2011, the contents of which are incorporated herein by reference in their entireties for all purposes.

FIELD OF INVENTION

The present invention relates generally to systems and methods for forming fiber webs, including fiber webs that are suitable for use as filter media and battery separators.

BACKGROUND

Fiber webs are used in a variety of applications, and in some embodiments can be used as filter media and battery separators. Generally, fiber webs can be formed of one or more fiber types including glass fibers, synthetic fibers, cellulose fibers, and binder fibers.

Fiber webs can be formed by a variety of processes. In some embodiments, fiber webs are formed by a wet laid process. A wet laid process may involve the use of similar equipment as a conventional papermaking process, which may include, for example, a hydropulper, a former or a headbox, a dryer, and an optional converter. Fibers may be collected on a screen or wire at an appropriate rate using any suitable machine such as a fourdrinier, a rotoformer, a cylinder, a pressure former, or an inclined wire fourdrinier. Although such processes may be used to form a variety of different fiber webs, improvements in the systems and methods for forming fiber webs would be beneficial and would find application in a number of different fields.

SUMMARY OF THE INVENTION

Systems and methods for forming fiber webs, including those suitable for use as filter media, are provided.

In one set of embodiments, a series of methods are provided. In one embodiment, a method of forming a fiber web comprises introducing a first fiber mixture and a second fiber mixture into a flow zone of a system for forming a fiber web, flowing the first fiber mixture in a lower portion of the flow zone, and flowing the second fiber mixture in an upper portion of the flow zone, wherein the lower and upper portions of the flow zone are separated by a lamella. The method also includes disrupting laminar flow of a fiber mixture in the lower portion or upper portion of the flow zone using a flow impediment positioned in the lower portion or upper portion of the flow zone, respectively. The method further includes collecting fibers from the first and second fiber mixtures in the fiber web forming zone, and forming a fiber web comprising fibers from the first and second fiber mixtures.

In one set of embodiments, a series of systems are provided. In one embodiment, a system for forming a fiber web comprises one or more flow distributors configured to dispense a first fiber mixture and a second fiber mixture, and a flow zone positioned downstream of the one or more flow distributors and configured to receive the first and second fiber mixtures. A lamella is positioned in the flow zone and separating the flow zone into a lower portion and an upper portion, and a flow impediment is positioned in one of the lower and upper portions of the flow zone for disrupting laminar flow of a fiber mixture in one of the lower and upper portions of the flow zone. The system also includes a fiber web forming zone, at least a part of which is positioned downstream of the flow zone, the fiber web forming zone configured to receive and collect fibers from the first and second fiber mixtures.

In another embodiment, a method of forming a fiber web comprises introducing a first fiber mixture and a second fiber mixture into a flow zone of a system for forming a fiber web, flowing the first fiber mixture in a lower portion of the flow zone, and flowing the second fiber mixture in an upper portion of the flow zone, wherein the lower and upper portions of the flow zone are separated by a lamella. The position and/or configuration of the lamella in the flow zone may be adjustable using a control system connected to the lamella. The method also includes collecting fibers from the first and second fiber mixtures in a fiber web forming zone, and forming a fiber web comprising fibers from the first and second fiber mixtures.

In another embodiment, a system for forming a fiber web comprises one or more flow distributors configured to dispense a first fiber mixture and a second fiber mixture, and a flow zone positioned downstream of the one or more flow distributors and configured to receive the first and second fiber mixtures. A lamella is positioned in the flow zone and separating the flow zone into a lower portion and an upper portion, wherein the position and/or configuration of the lamella in the flow zone is adjustable. A control system may be connected to the lamella for varying the position and/or configuration of the lamella in the flow zone. The system may also include a fiber web forming zone, at least a part of which is positioned downstream of the flow zone, the fiber web forming zone configured to receive and collect fibers from the first and second fiber mixtures.

In another embodiment, a system for forming a fiber web comprises one or more flow distributors configured to dispense a first fiber mixture and a second fiber mixture, and a flow zone positioned downstream of the one or more flow distributors and configured to receive the first and second fiber mixtures. A primary lamella is positioned in the flow zone and separating the flow zone into a lower portion and an upper portion, and a secondary lamella positioned in one of the lower and upper portions of the flow zone and positioned to divide portions of the first fiber mixture, or portions of the second fiber mixture, in the flow zone. The system also includes a fiber web forming zone, at least a part of which is positioned downstream of the flow zone, the fiber web forming zone configured to receive and collect fibers from the first and second fiber mixtures.

In another embodiment, a method of forming a fiber web comprises introducing a first fiber mixture and a second fiber mixture into a flow zone of a system for forming a fiber web, flowing the first fiber mixture in a lower portion of the flow zone, and flowing the second fiber mixture in an upper portion of the flow zone. The lower and upper portions of the flow zone are separated by a primary lamella, and a secondary lamella may be positioned within one of the lower and upper portions of the flow zone. The second lamella is positioned to divide portions of the first fiber mixture, or portions of the second fiber mixture, in the flow zone. The method further includes collecting fibers from the first and second fiber mixtures in a fiber web forming zone, and forming a fiber web comprising fibers from the first and second fiber mixtures.

In another embodiment, a system for forming a fiber web comprises one or more flow distributors configured to dispense a first fiber mixture and a second fiber mixture and a flow zone positioned downstream of the one or more flow distributors and configured to receive the first and second fiber mixtures. The system may include a lamella positioned in the flow zone and separating the flow zone into a lower portion and an upper portion, and a disruptive member positioned in one of the lower and upper portions of the flow zone. The system may further include a fiber web forming zone, at least a part of which is positioned downstream of the flow zone, the fiber web forming zone configured to receive and collect fibers from the first and second fiber mixtures.

In another embodiment, a method of forming a fiber web comprises introducing a first fiber mixture and a second fiber mixture into a flow zone of a system for forming a fiber web, wherein the flow zone comprises a lower portion and an upper portion that are separated by a lamella, and wherein the flow zone includes a disruptive member positioned therein. The method involves collecting fibers from the first and second fiber mixtures in a fiber web forming zone and forming a fiber web comprising fibers from the first and second fiber mixtures.

In another embodiment, a system for forming a fiber web comprises one or more flow distributors configured to dispense a first fiber mixture and a second fiber mixture, and a flow zone positioned downstream of the one or more flow distributors and configured to receive the first and second fiber mixtures. The system may also include a lamella positioned in the flow zone and separating the flow zone into a lower portion and an upper portion, the lamella having an upper surface and a lower surface, and a textured surface portion associated with at least one of the upper and lower surfaces, wherein the textured surface portion comprises a plurality of surface features. The system further includes a fiber web forming zone, at least a part of which is positioned downstream of the flow zone, the fiber web forming zone configured to receive and collect fibers from the first and second fiber mixtures.

In another embodiment, a method of forming a fiber web comprises introducing a first fiber mixture and a second fiber mixture into a flow zone of a system for forming a fiber web, flowing the first fiber mixture in a lower portion of the flow zone, and flowing the second fiber mixture in an upper portion of the flow zone, wherein the lower and upper portions of the flow zone are separated by a lamella. The lamella has an upper surface and a lower surface, and a textured surface portion associated with at least one of the upper and lower surfaces. The textured surface portion of the lamella comprises a plurality of surface features. The method also involves collecting fibers from the first and second fiber mixtures in a fiber web forming zone, and forming a fiber web comprising fibers from the first and second fiber mixtures.

In another embodiment, a system for forming a fiber web comprises one or more flow distributors configured to dispense a first fiber mixture and a second fiber mixture and a flow zone positioned downstream of the one or more flow distributors and configured to receive the first and second fiber mixtures. A lamella may be positioned in the flow zone and may separate the flow zone into a lower portion and an upper portion, the lamella comprising a variable volume member. The system may also include a fiber web forming zone, at least a part of which is positioned downstream of the flow zone, the fiber web forming zone configured to receive and collect fibers from the first and second fiber mixtures.

In another embodiment, a method of forming a fiber web comprises introducing a first fiber mixture and a second fiber mixture into a flow zone of a system for forming a fiber web, flowing the first fiber mixture in a lower portion of the flow zone, and flowing the second fiber mixture in an upper portion of the flow zone, wherein the lower and upper portions of the flow zone are separated by a lamella comprising a variable volume member. The method further includes collecting fibers from the first and second fiber mixtures in a fiber web forming zone, and forming a fiber web comprising fibers from the first and second fiber mixtures.

In another embodiment, a system for forming a fiber web comprises one or more flow distributors configured to dispense a first fiber mixture and a second fiber mixture, and a flow zone positioned downstream of the one or more flow distributors and configured to receive the first and second fiber mixtures. The system also includes a lamella positioned in the flow zone and separating the flow zone into a lower portion and an upper portion, and a pivoting member attached to the lamella for varying the angle of at least a portion of the lamella within the flow zone. The system further includes a fiber web forming zone, at least a part of which is positioned downstream of the flow zone, the fiber web forming zone configured to receive and collect fibers from the first and second fiber mixtures.

In another embodiment, a method of forming a fiber web comprises introducing a first fiber mixture and a second fiber mixture into a flow zone of a system for forming a fiber web, flowing the first fiber mixture in a lower portion of the flow zone, and flowing the second fiber mixture in an upper portion of the flow zone. The lower and upper portions of the flow zone are separated by a lamella having attached thereto a pivoting member for varying the angle of at least a portion of the lamella within the flow zone. The method involves collecting fibers from the first and second fiber mixtures in a fiber web forming zone, and forming a fiber web comprising fibers from the first and second fiber mixtures.

In another embodiment, a system for forming a fiber web comprises one or more flow distributors configured to dispense a first fiber mixture and a second fiber mixture, a flow zone positioned downstream of the one or more flow distributors and configured to receive the first and second fiber mixtures, and a lamella positioned in the flow zone and separating the flow zone into a lower portion and an upper portion, wherein the length of the lamella in the flow zone is adjustable. The system also includes a fiber web forming zone, at least a part of which is positioned downstream of the flow zone, the fiber web forming zone configured to receive and collect fibers from the first and second fiber mixtures.

In another embodiment, a method of forming a fiber web comprises introducing a first fiber mixture and a second fiber mixture into a flow zone of a system for forming a fiber web, flowing the first fiber mixture in a lower portion of the flow zone, and flowing the second fiber mixture in an upper portion of the flow zone. The lower and upper portions of the flow zone may be separated by a lamella having a length that is adjustable. The method may include collecting fibers from the first and second fiber mixtures in a fiber web forming zone, and forming a fiber web comprising fibers from the first and second fiber mixtures.

Other aspects, embodiments, advantages and features of the invention will become apparent from the following detailed description.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Systems and methods for forming fiber webs, including those suitable for use as filter media and battery separators, are provided. In some embodiments, the systems and methods may involve the use of one or more fiber mixtures to form a fiber web. The fiber mixtures may flow in different portions of a system for forming a fiber web that may be separated by a lamella, and may join at a fiber web forming zone to produce a fiber web having multiple layers. The amount of mixing of the fiber mixtures at or near the fiber web forming zone may be controlled to produce fiber webs having different structural and/or performance characteristics. For example, in some embodiments, a flow impediment (e.g., a secondary lamella, a disruptive member, a textured surface portion, and/or a variable volume member) positioned within the system can be used to disrupt laminar flow and to promote mixing at the fiber web forming zone. In some embodiments, the systems and methods described herein can be used to form fiber webs having a gradient in a property across a portion of, or the entire, thickness of the fiber web. Other features and advantages of the systems and methods described herein are provided below.

As described herein, in some embodiments, a system for forming a fiber web includes a lamella that separates the flow zone into an upper portion and a lower portion. In certain embodiments, the position and/or configuration of the lamella in the flow zone is adjustable. Optionally, a control system may be connected to the lamella, or a component attached thereto, for varying the position and/or configuration of the lamella in the flow zone. In certain embodiments, a lamella includes a pivoting member attached thereto for changing the angle of at least a portion of the lamella in the flow zone. In other instances, the length of the lamella is adjustable. In other cases, the lamella includes a variable volume member which can be expanded and/or contracted. Other examples are described in more detail below.

Figure 1:
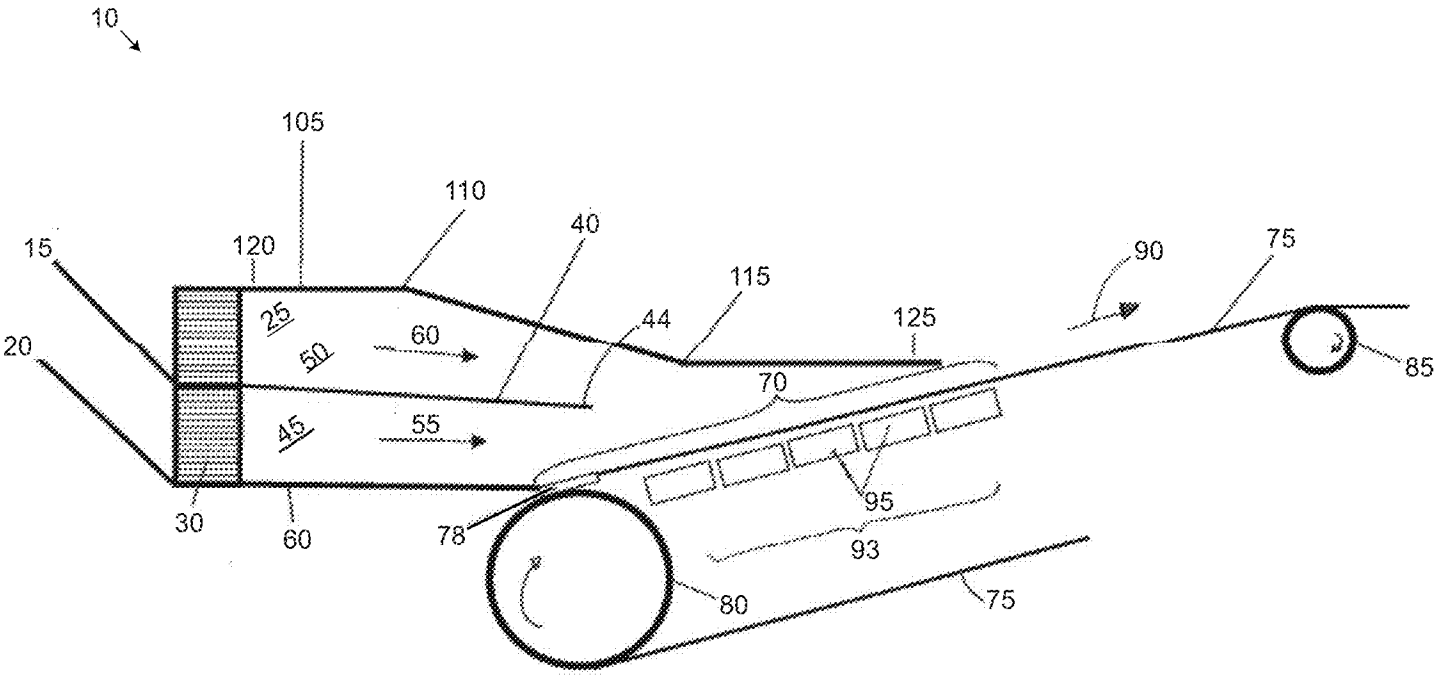
FIG. 1 is a schematic diagram showing a system for forming a fiber web according to one set of embodiments.

An example of a system for forming a fiber web using a wet laid process is shown in the embodiment illustrated in FIG. 1. As shown illustratively in FIG. 1, a system 10 may include flow distributors 15 and 20 (e.g., headboxes) configured to dispense one or more fiber mixtures into a flow zone 25 positioned downstream of the one or more flow distributors. Although two distributors are shown in FIG. 1, in some embodiments only a single flow distributor may be present; in other embodiments, three or more flow distributors may be present (e.g., for introducing three or more fiber mixtures into the system). In some embodiments, a distributor block 30 may be positioned between the one or more flow distributors and the flow zone. The distributor block may help to evenly distribute the one or more fiber mixtures across the width of the flow zone upon the mixture(s) entering the flow zone. Different types of distributor blocks are known in the art and can be used in the systems described herein. Alternatively, in some embodiments, the system need not include a distributor block.

As shown in the exemplary embodiment of FIG. 1, system 10 may include a lamella 40 (e.g., a primary lamella) positioned in the flow zone. The lamella may be used as a partition to divide the flow zone into a lower portion 45 and an upper portion 50 (or into additional portions when multiple lamellas are present, as described in more detail below). In certain embodiments, the lamella can be used to separate a first fiber mixture flowing in the lower portion of the flow zone from a second fiber mixture flowing in the upper portion of the flow zone. For example, a first fiber mixture dispensed from flow distributor 20 into the lower portion 45 of the flow zone may be separated from a second fiber mixture dispensed from flow distributor 15 into the upper portion 50 of the flow zone until the mixtures reach a downstream end 44 of the lamella, after which the first and second fiber mixtures are allowed to meet. The first and second fiber mixtures generally flow in the lower and upper portions of the flow zone in a downstream direction (e.g., in the direction of arrows 55 and 60, respectively). The flow profile of the fluids in the lower and upper portions of the flow zone can be altered, in part, by choosing a lamella with appropriate features, as described in more detail below. In some embodiments, one or more flow impediments, such as a secondary lamella, a disruptive member, a textured surface portion, and a variable volume member, may be present in one or both of the lower and upper portions of the flow zone. The one or more flow impediments may be used for disrupting laminar flow, as described in more detail below.

A fiber web forming zone 70 may be configured to receive the first and second fiber mixtures. The fiber web forming zone is generally positioned downstream of the flow zone, although it may include portions of the flow zone. For example, in some embodiments, the fiber web forming zone may include a portion of the lower portion of the flow zone, as well as apron 78 which may be used to connect a bottom surface 100 of the flow zone to a wire 75. The wire may be a perforated support used to receive and collect the fibers as the wire rotates about a breast roll 80 and a couch roll 85. As such, the wire may be used to transport the fibers collected from the fiber mixtures in the general direction of arrow 90 for further downstream processing, while allowing liquid from the fiber mixtures to be removed by gravity and/or by a dewatering system 93. Any suitable dewatering system can be used, including a series of vacuum boxes 95. The wire may be positioned at an incline with respect to the horizontal as shown in FIG. 1, although other positions are also possible, including having the wire at a horizontal position itself. In some embodiments, the fiber web forming zone is entirely downstream of the flow zone.

As shown illustratively in FIG. 1, in some embodiments system 10 may be a substantially closed system in which the flow zone is substantially enclosed by bottom surface 100 and a top surface 105. The top surface may include one or more joints 110 and 115, which may be used to shape the top surface and affect the flow profile of one or more fiber mixtures flowing in the system. It should be appreciated that configurations other than the ones shown in FIG. 1 are possible. For example, in some embodiments the top surface does not include any joints 110 or 115. In other embodiments, bottom surface 100 may include one or more joints. Additionally, although surfaces 100 and 105 are shown as flat portions of material, in other embodiments these surfaces may be curved or have any other suitable shape. Furthermore, one or more portions of the bottom and/or top surface may be horizontal, positioned at an incline with respect to the horizontal, or positioned at a decline with respect to the horizontal.

In certain embodiments, system 10 may be a pressure former. System 10 may be a closed system and the pressure of the one or more fiber mixtures in the flow zone may be maintained and/or controlled by, for example, controlling the pressure or volume of the one or more fiber mixtures introduced into the flow zone and controlling the distance between the top surface and the bottom surface or wire (e.g., the void volume in the forming zone).

In some cases, system 10 is an open system and does not include a top surface 110. In other cases, system 10 does not include a bottom surface 100 but instead, a fiber mixture flows directly onto a wire. Other configurations are also possible.

The size of system 10, which may be controlled in part by choosing appropriate dimensions for the top and/or bottom surfaces of the system, may vary as desired. For example, in some embodiments, the length of the top surface may range from about 300 mm to about 2,000 mm (e.g., between about 300 mm to about 1,000 mm, between about 600 mm to about 1,700 mm, or between about 1,000 mm to about 2,000 mm). In some embodiments, the length of the top surface may be, for example, greater than about 300 mm, greater than about 600 mm, greater than about 1,000 mm, greater than about 1,400 mm, or greater than about 1,700 mm. In other embodiments, the length of the top surface may be, for example, less than about 2,000 mm, less than about 1,700 mm, less than about 1,400 mm, less than about 1,000 mm, or less than about 600 mm. Other lengths are also possible. In some embodiments, the length of the top surface is determined by measuring the absolute distance between the two ends of the top surface. In other embodiments, the length of the top surface is determined by measuring the sum of the lengths of the surface portions of the top surface (including the lengths of each portion of the top surface between any joints).

The length of the bottom surface may range from, for example, about 100 mm to about 2,000 mm (e.g., between about 100 mm to about 700 mm, between about 300 mm to about 1,000 mm, between about 300 mm to about 800 mm, or between about 1,000 mm and about 2,000 mm). In some embodiments, the length of the bottom surface may be, for example, greater than about 100 mm, greater than about 300 mm, greater than about 500 mm, greater than about 700 mm, or greater than about 1,200 mm. In other embodiments, the length of the bottom surface may be, for example, less than about 1,700, less than about 1,300, less than about 1,000 mm, less than about 700 mm, less than about 500 mm, or less than about 300 mm. Other lengths are also possible. In some embodiments, the length of the bottom surface is determined by measuring the absolute distance between the two ends of the bottom surface. In other embodiments, the length of the bottom surface is determined by measuring the sum of the lengths of the surface portions of the bottom surface (including the lengths of the bottom surface between any joints).

The width of the top and bottom surfaces may also vary. In some cases, the average width of the top or bottom surface is between about 500 mm and about 12,500 mm (e.g., between about 6,000 mm and about 12,500 mm, between about 500 mm and about 6,000 mm, or between about 3,000 and about 9,000 mm). In some embodiments, the average width of the top or bottom surface may be, for example, greater than about 500 mm, greater than about 1,000 mm, greater than about 3,000 mm, greater than about 6,000 mm, or greater than about 9,000 mm. In other embodiments, the width of the top or bottom surface may be, for example, less than about 12,500 mm, less than about 9,000 mm, less than about 6,000 mm, less than about 3,000 mm, or less than about 1,000 mm. Other average widths of the top or bottom surfaces are also possible.

The width of the top and bottom surfaces may be substantially uniform across the length of the surface, or in other embodiments, may vary along the length of the surface. For example, in some cases, an upstream portion 120 of the top surface may be wider than a downstream portion 125 of the top surface, and may optionally taper from the upstream to the downstream portions. The bottom surface may have a configuration similar to that the top surface, or may different from that other top surface. Other configurations are also possible.

The top and bottom surfaces can be made of any suitable material. Generally, the materials for top and bottom surfaces are chosen for their strength and anti-corrosion properties. Examples of suitable materials may include metals (e.g., stainless steel, composite steels), polymers (e.g., soft latex, rubbers, high density polyethylene, epoxy, vinylester, polyester), fiber-reinforced polymers (e.g., using fiberglass, carbon, or aramid fibers), ceramics, and combinations thereof. The top and bottom surfaces may be formed of a single piece of material, or may be formed by combining two or more pieces of materials.

The size of system 10 may also be controlled in part by choosing appropriate distances between the top and bottom surfaces of the system and/or an appropriate height of the distributor block. Generally, a distance between the top and bottom surfaces at the upstream end of flow zone, and/or a height of a distributor block, may be between about 10 mm and about 2,000 mm (e.g., between about 10 mm and about 500 mm, between about 500 mm and about 1,000 mm, or between about 1,000 mm and about 2,000 mm). In some cases, the distance between the top and bottom surfaces at the upstream end of flow zone, and/or a height of a distributor block, may be greater than about 10 mm, greater than about 200 mm, greater than about 500 mm, greater than about 1,000 mm, greater than about 1,500 mm. In other cases, the distance between the top and bottom surfaces at the upstream end of flow zone, and/or a height of a distributor block, may be less than about 2,000 mm, less than about 1,500 mm, less than about 1,000 mm, less than about 500 mm, or less than about 200 mm. Other values are also possible.

It should be appreciated that the components in system 10 are not limiting and that in some embodiments, certain components shown in FIG. 1 (or certain components in any of FIGS. 2-13) need not be present in a system, and in other embodiments, other components may optionally be present. It should also be appreciated that any of the description herein pertaining to the systems and components shown in FIG. 1, including the methods of operating the systems and components shown in FIG. 1, may also be applied to the other systems and components described herein such as those shown in FIGS. 2-13. Moreover, it should be appreciated that various components shown in the figures and/or described herein may be combined into a single system for forming a fiber web in some embodiments, As an example of alternative embodiments that are possible with respect to FIG. 1, system 10 may further include, in some embodiments, a secondary flow distributor (not shown) positioned downstream of fiber web forming zone 70. The secondary flow distributor may be used to position one or more additional layers on top of the fiber web formed using the system shown in FIG. 1. The secondary flow distributor may be positioned so that wire 75 carrying the drained fibers from fiber web forming zone 70 passes underneath the secondary flow distributor. One or more secondary fiber mixtures can then be laid on top of, and then drained through, the already formed fiber web. The water can then be removed by a secondary dewatering system resulting in a combined web including fibers from the system shown in FIG. 1 as one or more bottom layers, and fibers from the secondary flow distributor as a top layer. The resulting fiber web can be dried by various methods such as by passing over a series of dryer cans. The dried web can then be optionally wound into rolls at a reel.

Optionally, one or more secondary flow distributors and/or other components can be used to add one or more additives to a fiber web. A secondary flow distributor may be used to introduce, for example, a binder and/or other additives to a pre-formed fiber web. In one such embodiment, as a pre-formed fiber web is passed along the wire, a binder resin (which may be in the form of one or more emulsions) may be added to the fiber web. The binder resin may be pulled through the fiber web using dewatering system 93, or a separate dewatering system further downstream. In certain embodiments, one or more of the components included in the binder resin may be diluted with softened water and pumped into the fiber web. Other systems and methods for introducing additives to a fiber web are also possible.

As described above, a lamella may be positioned in the flow zone to partition the flow zone into at least an upper portion and a bottom portion. Although a single lamella is shown in the system illustrated in FIG. 1, in other embodiments the flow zone may not include a lamella positioned therein, or the flow zone may include more than one lamella (e.g., additional primary lamellas) for separating three or more fiber mixtures. In some such embodiments, the flow zone may be separated into three, four, or more distinct portions, each of which may contain a different fiber mixture. The lamella may be positioned in any suitable position within the flow zone, and may vary depending on relative volumes of the fiber mixtures in the upper and lower portions of the flow zone. For example, although FIG. 1 shows the lamella being positioned at the center of the distributor block to allow substantially equal volumes and/or flow velocities of the fiber mixtures in each of the upper and lower portions of the flow zone, in other embodiments the lamella may be positioned higher or lower with respect to the distributor block to allow a larger or smaller portion of one fiber mixture in the flow zone relative to the other. Furthermore, although FIG. 1 shows that the lamella is positioned at a slight decline with respect to the horizontal, in other embodiments the lamella may be substantially horizontal, or positioned at an incline with respect to the horizontal. Other positions of the lamella in the flow zone are also possible.

A lamella may be attached to a portion of a system for forming a fiber web using any suitable attachment technique. In some embodiments, a lamella is attached directly to a distributor block. In other embodiments, a lamella is attached to a threaded rod positioned vertically within a portion of the flow zone. In certain embodiments, attachment involves the use of adhesives, fasteners, metallic banding systems, railing mechanisms, or other support mechanisms. Other attachment mechanisms are also possible.

The lamella may have any suitable dimensions. In some embodiments, the lamella has a length of, for example, between about 1 mm and about 2,000 mm (e.g., between about 100 mm and about 500 mm, between about 100 mm and about 1,000 mm, or between about 1,000 mm and about 2,000 mm). The length of the lamella may be, for example, greater than about 1 mm, greater than about 100 mm, greater than about 300 mm, greater than about 500 mm, or greater than about 1,000 mm. In other cases, the length of the lamella is less than about 2,000 mm, less than about 1,000 mm, less than about 500 mm, less than about 300 mm, or less than about 100 mm. The length of the lamella is determined by measuring the absolute length of the lamella. In some instances, the lamella extends from the distributor block to the dewatering system (e.g., an upstream-most vacuum box). In other instances, the lamella extends from the distributor block until the downstream end of the top surface. Other configurations are also possible.

The width of the lamella typically extends the width of the flow zone, although other configurations are also possible.

The thickness of the lamella can also vary. For example, the average thickness of the lamella may be between about 1/16" to about 4" (e.g., between about 1/16" to about 1", between about 1" to about 4", between about 1/8" to about 1/4", or between about 1/8" to about 1/6"). In some cases, the average thickness of the lamella is greater than about 1/8", greater than about 1/6", greater than about 1/4", greater than about 1/2", greater than about 1", or greater than about 2". In other cases, the average thickness of the lamella is less than about 2", less than about 1", less than about 1/2", less than about 1/4", less than about 1/6", or less than about 1/8". In yet other embodiments, the thickness of the lamella can vary along the length of the lamella. For example, the thickness of the lamella may taper along its length (e.g., from about 1/4" to about 1/8"). Other thicknesses are also possible.

The lamella can be made of any suitable material. Generally, the materials for the lamella are chosen for their strength and anti-corrosion properties. Examples of suitable materials may include metals (e.g., stainless steel, composite steels), polymers (e.g., soft latex, rubbers, high density polyethylene, epoxy, vinylester, polyester), fiber-reinforced polymers (e.g., using fiberglass, carbon, or aramid fibers), ceramics, and combinations thereof. The lamella may be formed of a single piece of material, or may be formed by combining two or more pieces of materials.

As described herein, in some embodiments, a system can be used to form a fiber web including two or more layers, e.g., using first and second fiber mixtures. In some embodiments, it is desirable to reduce or limit the amount of mixing between the first and second fiber mixtures at or near the fiber web forming zone. Typically, the fiber mixtures are flowed laminarly in the flow zone to achieve limited amounts of mixing. In other embodiments, it is desirable to promote larger amounts of mixing between the first and second fiber mixtures at or near the fiber web forming zone. In such embodiments, the flow of a fiber mixture in at least a portion of the flow zone may be non-laminar (e.g., turbulent). The degree of mixing of the first and second fiber mixtures may control the presence, absence, and/or type of gradient in the resulting fiber web, as described in more detail herein.

Laminar flow is generally characterized by the flow of a fluid having a relatively low Reynolds number. In some embodiments, flow of a fiber mixture in at least a portion of a flow zone is laminar and may have a Reynolds number of, for example, less than about 2,300, less than about 2,100, less than about 1,800, less than about 1,500, less than about 1,200, less than about 900, less than about 700, or less than about 400. The Reynolds number may have a range from, for example, between about 2,300 and about 100. Other values and ranges of Reynolds numbers are also possible.

In some embodiments, the flow of a fiber mixture in at least a portion of a flow zone is non-laminar (e.g., turbulent), and may have a Reynolds number that is greater than about 2,100, greater than about 2,300, greater than about 3,000, greater than about 5,000, greater than about 10,000, greater than about 13,000, or greater than about 17,000. The Reynolds number may have a range from, for example, between about 2,100 and about 20,000. Other values and ranges of Reynolds numbers are also possible.

The flow of a fiber mixture may also have a Reynolds number at the transition between laminar and turbulent flow (e.g., between about 2,100 and about 4,000). Other values and ranges of Reynolds numbers are also possible. Those of ordinary skill in the art can vary the Reynolds number of a flow by, for example, altering the flow velocity of the fiber mixture, viscosity of the fiber mixture, density of the fiber mixture, the type, number, size, and position of features in a textured surface of a lamella (if present), the degree of expansion and/or contraction of a variable volume member associated with a lamella (if present), the length of the lamella, the angle of the lamella, the presence of any flow impediments in the flow zone, and/or the dimensions of the flow zone using known methods in combination with the description provided herein.

As described herein, in some embodiments, a flow zone may include one or more flow impediments that can disrupt laminar flow within the flow zone. For example, a lamella may include features that exhibit a gradient in the features' abilities to disrupt laminar flow along the length of the lamella. The features may, for instance, be used to change the Reynolds number of a fiber mixture flowing along the length of the lamella. For example, the Reynolds number of a fiber mixture may change by at least about 200, at least about 500, at least about 1,000, at least about 2,000, at least about 5,000, or at least about 10,000 from a first position in the flow zone to a second position in the flow zone as a result of the different features. In some cases, the Reynolds number increases (or decreases) by at least about 10%, at least about 20%, at least about 40%, at least about 60%, at least about 80%, at least about 100%, at least about 150%, or at least about 200% from a first position in the flow zone to a second position in the flow zone. The first and second positions for measuring Reynolds number may be above the lamella (e.g., in an upper portion of the flow zone), or below the lamella (e.g., in a lower portion of the flow zone). In some embodiments, the first and second positions are greater than about 100 mm, greater than about 500 mm, greater than about 1,000 mm, or greater than about 1,500 mm apart. In other embodiments, the first and second positions are less than about 2,000 mm, less than about 1,500 mm, less than about 1,000 mm, less than about 500 mm, or less than about 100 mm apart. Other values are also possible.

The degree of mixing of the first and second fiber mixtures can be controlled by varying different parameters. Examples of parameters that can be varied to control the level of mixing between fiber mixtures include, but are not limited to, the type, number, size, and position of features in a textured surface of a lamella (if present), the degree of expansion and/or contraction of a variable volume member associated with a lamella (if present), the presence of any flow impediments in the flow zone, the magnitude of the flow velocities of the fiber mixtures flowing in the flow zone, the relative difference in flow velocities between fiber mixtures flowing in the lower and upper portions of the flow zone, the flow profile of the fiber mixtures flowing in the lower and upper portions of the flow zone (e.g., laminar flow or turbulent flow), the volume of the flow zone (including the relative volumes of the lower and upper portions of the flow zone), the length of the lamella, the angle of the lamella, the number of lamellas present in the flow zone, the position of the end(s) of the lamella(s) relative to where the dewatering system (e.g., vacuum boxes) begins, the size and length of the forming zone, the level of vacuum used (if any) in the dewatering system, the density of the fiber mixtures (including the difference in densities of the fiber mixtures in the lower and upper portions of the flow zone), the particular chemistry of the fiber mixtures (e.g., pH, presence/absence of particular viscosity modifiers) including the difference in chemistry of the fiber mixtures in the lower and upper portions of the flow zone, and the sizes (e.g., lengths, diameters) of the fibers in the fiber mixtures. In certain embodiments described herein, one or more of such parameters are varied to control the degree of mixing between fiber mixtures.

As described herein, in some embodiments, at least some mixing between fiber mixtures is desired at or near the fiber web forming zone to create a gradient in one or more properties in a fiber web. Intermixing between fiber mixtures may be produced, in some embodiments, by creating turbulent flow at or near the downstream end of the lamella where two fiber mixtures meet (e.g., at or near the fiber web forming zone). Turbulent flow at or near the downstream end of the lamella may be promoted by, for example, disrupting laminar flow in one or more regions of the flow zone. For example, in some cases laminar flow is disrupted in the lower portion of the flow zone such that the fiber mixture in that portion, upon reaching the downstream end of the lamella, interjects into at least a part of the fiber mixture above it. Eddies may be formed that cause mixing of the fiber mixtures at the fluid interface between the mixtures. Likewise, intermixing can be produced by disrupting laminar flow in an upper portion of the flow zone such that, upon the fiber mixture in the upper portion reaching the downstream end of the lamella, at least a part of the fiber mixture interjects into the fiber mixture below it. In other embodiments, laminar flow in both the upper and lower portions of the flow zone can promote intermixing of the fiber mixtures at or near the fiber web forming zone.

In general, a fiber mixture may have any suitable flow velocity. As described herein, the flow velocity of a fiber mixture may vary in a portion of flow zone (e.g., in a lower or upper portion of the flow zone) and/or a fiber web forming zone, e.g., as shown in any of the figures. In some embodiments, the flow velocity of a fiber mixture varies between about 1 m/min to about 1,000 m/min (e.g., between about 1 m/min to about 100 m/min, between about 10 m/min to about 50 m/min, between about 100 m/min to about 500 m/min, or between about 500 m/min to about 1,000 m/min), although other ranges are also possible. In some embodiments, the flow velocity of a fiber mixture may be greater than about 1 m/min, greater than about 10 m/min, greater than about 20 m/min, greater than about 30 m/min, greater than about 40 m/min, greater than about 50 m/min, greater than about 70 m/min, greater than about 100 m/min, greater than about 300 m/min, greater than about 600 m/min, or greater than about 1,000 m/min. In other embodiments, the flow velocity of a fiber mixture may be less than about 1,800 m/min, less than about 1,500 m/min, less than about 1,000 m/min, less than about 600 m/min, less than about 300 m/min, less than about 200 m/min, less than about 100 m/min, less than about 70 m/min, less than about 50 m/min, less than about 40 m/min, less than about 30 m/min, less than about 20 m/min, or less than about 10 min/min. Combinations of the above-noted ranges are also possible (e.g., a flow velocity of greater than about 10 m/min and less than about 1,000 m/min). The fiber mixtures may have such flow velocities before and/or after adjustment of the angle of a lamella, as described herein. Other values of flow velocity are also possible.

In some embodiments, a system for forming a fiber web includes one or more flow impediments positioned in a portion of the flow zone for disrupting laminar flow of a fiber mixture in the flow zone and/or fiber web forming zone. Examples of flow impediments include secondary lamellas, disruptive members, textured surface portions, and variable volume members positioned in a portion of a flow zone, as described in more detail below. A method of forming a fiber web may include, in some embodiments, disrupting laminar flow of a fiber mixture in a portion of the flow zone and/or fiber web forming zone using a flow impediment positioned, for example, in the lower portion or upper portion of the flow zone. The flow impediment may facilitate intermixing of the first and second fiber mixtures at a fiber web forming zone, at least a part of which is positioned downstream of flow zone. In certain embodiments, the position and/or configuration of a flow impediment in the flow zone is adjustable, and a control system may be connected to the flow impediment for varying the position and/or configuration of the flow impediment in the flow zone. For example, a control system may be connected to a flow impediment, and may be used to control the height, horizontal position, rotational rate, and/or degree of expansion/contraction of the flow impediment in the flow zone.

As described herein, in some embodiments, a system for forming a fiber web includes more than one lamella positioned in a flow zone, e.g., for disrupting laminar flow. For example, as shown in the embodiment illustrated in FIG. 2, a system 135 may include, in addition to a lamella 140 (e.g., a primary lamella) which separates flow zone 25 into lower portion 45 and upper portion 50, a secondary lamella 145 which may be positioned in the lower portion of the flow zone to divide portions of the fiber mixture flowing in the lower portion. A secondary lamella is generally used to separate portions of a single fiber mixture and may be used to enhance fiber mixing in a portion of the flow zone, whereas a primary lamella may be used to separate two fiber mixtures into main portions within the flow zone (e.g., an upper portion and a lower portion of a flow zone). Additionally or alternatively to secondary lamella 145 being positioned in the lower portion of the flow zone, a secondary lamella 150 may be positioned in the upper portion of the flow zone to divide portions of a fiber mixture flowing in the upper portion. In one such embodiment, a first fiber mixture flowing in the lower portion of the flow zone may be separated into two portions, one below lamella 145 and one above it. Similarly, a second fiber mixture flowing in the upper portion of the flow zone may be separated into two portions, one below lamella 150 and one above it. The positioning of a lamella within a portion of a flow zone to separate a fiber mixture into different portions may increase the level of turbulence (e.g., non-laminar flow) within that fiber mixture. As described herein, the increase in turbulence in a portion of the flow zone can result in the intermixing between fiber mixtures at a fiber web forming zone. This intermixing may cause the formation of one or more gradients across all or portions of the thickness of the resulting fiber web, as described herein.

As shown illustratively in FIG. 2, in some embodiments, a secondary lamella may be used to separate portions of a single fiber mixture, e.g., such that the fiber mixture flowing above the secondary lamella is the same as the fiber mixture flowing below it.

Figure 2:
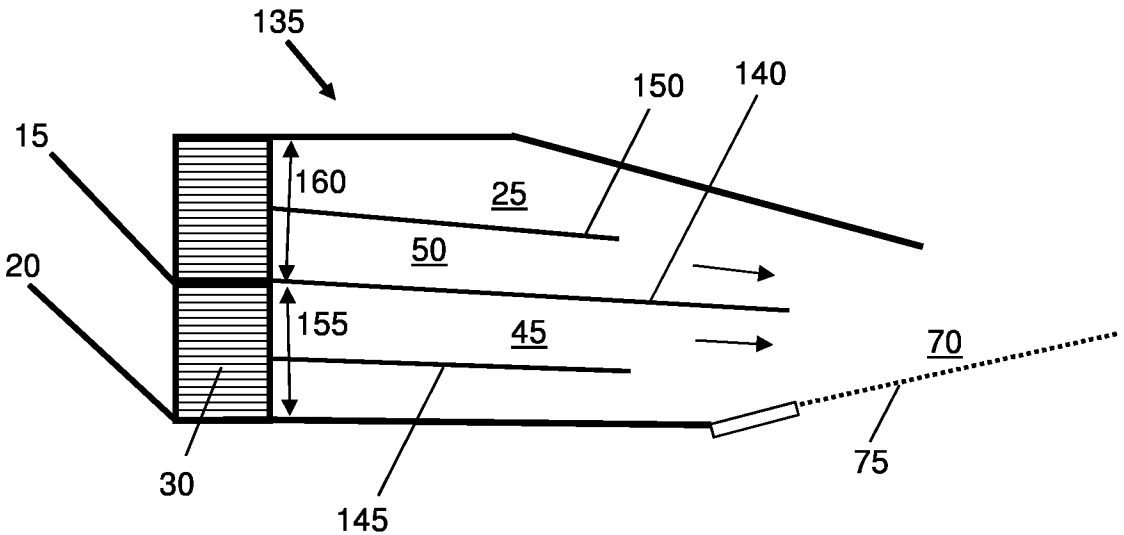
FIG. 2 is a schematic diagram showing a system for forming a fiber web including multiple lamellas according to one set of embodiments.

Although a single secondary lamella is positioned within each of the lower and upper portions of the flow zone in the embodiment illustrated in FIG. 2, in other embodiments, additional secondary lamellas can be positioned in a portion of a flow zone to separate a single fiber mixture in that flow zone. For example, in some embodiments, 2, 3, 4, 5, etc. lamellas can be positioned within a flow zone to separate a single fiber mixture into several portions. Furthermore, although FIG. 2 shows a secondary lamella in each of lower and upper portions of the flow zone, in other embodiments, one of secondary lamellas 145 or 150 may be absent.

In yet another embodiment, a flow zone may be configured to receive a third fiber mixture, and the system may include a second primary lamella that separates the flow zone into three main portions. The second primary lamella may be positioned to divide the third fiber mixture from the first and/or second fiber mixtures in the flow zone. The different primary lamellas may have the same length, or different lengths. Optionally, a secondary lamella may be positioned in one of the three portions of the flow zone to divide portions of a fiber mixture in that portion. The different secondary lamellas may have the same length, or different lengths. Similarly, additional fiber mixtures (e.g., 4, 5, 6, etc., fiber mixtures) may be added with concurrent additional primary lamellas and optional secondary lamellas as desired. Other configurations are also possible.

A secondary lamella may be positioned at any suitable position within a portion of a flow zone. For example, although each of secondary lamellas 145 and 150 in FIG. 2 is positioned within the center of the lower and upper portions of the flow zone, respectively, in other embodiments a secondary lamella may be positioned higher or lower as desired.

In some embodiments, a lamella (e.g., a primary lamella such as lamella 140 or a secondary lamella such as lamellas 145 or 150) has an adjustable height within the flow zone. For example, the height of lamella 145 within lower portion 45 of the flow zone may be varied along a height 155 of the lower portion of the flow zone, and the height of lamella 150 within upper portion 50 of the flow zone may be varied along a height 160 of the upper portion of the flow zone. In some embodiments, the height of a secondary lamella within a portion of a flow zone may be varied to control the degree of turbulence in that portion of the flow zone and/or at a fiber web forming zone.

A variety of control systems, including different mechanisms, for controlling the height of a lamella in a flow zone can be implemented. For example, in one embodiment a control system may include an adjustment wheel which can be connected to a lamella to allow control of the height of the lamella within the flow zone. In another embodiment, a servomechanism can be used. In certain embodiments, a lamella is connected to a motor (e.g., an electric motor) which can allow adjustments of the height of the lamella. In certain embodiments, a control system may include mechanical, electromechanical, hydraulic, pneumatic or magnetic systems that can be used to control height. All or portions of the control system/mechanism may extend outside of the flow zone in some embodiments, and may be either manually or automatically controlled. Combinations of different mechanisms and/or control systems can also be used. Other mechanisms and configurations for controlling height of a lamella are also possible.

In some embodiments, a lamella (e.g., a primary lamella and/or a secondary lamella) includes a control system or mechanism for controlling height that is electronically controlled. Adjustments of the height of a lamella may be controlled by the control system and may take place automatically by, for example, an automated control system and/or may be controlled by input from a user. The one or more control systems can be implemented in numerous ways, such as with dedicated hardware and/or firmware, using a processor that is programmed using microcode or software to perform the functions described herein. In certain embodiments, instructions for adjusting the height of one or more lamellas are pre-programmed into the control system, e.g., prior to initiating a production run. In some embodiments, control of the height of one or more lamellas involves the use of sensors and/or negative feedback (e.g., using a servomechanism). A control system can be used to adjust the height of several secondary lamellas (e.g., simultaneously or alternately) in some embodiments.

Where more than one lamellas are present, the height of the lamellas may be controlled independently of one another. For instance, the height of the lamellas may be controlled independently such that each of the heights of the lamellas can change depending on its location in the flow zone, the amount of fluid and/or pressure in the flow zone, the type of fiber mixture(s) in the flow zone, the amount of turbulence desired, and/or other conditions. For example, in one embodiment in which a lower portion of a flow zone includes a secondary lamella and an upper portion of the flow zone includes another secondary lamella, the flow profiles in each of the lower and upper portions of the flow zone can be modified independently by varying the respective heights of the secondary lamellas.

In other embodiments, a lamella is substantially fixed within a flow zone. For example, in one embodiment, in order to adjust the height of a fixed lamella within the flow zone, flow of the one or more fiber mixtures in the flow zone is ceased and the fiber mixtures are removed from the flow zone before adjusting the height of the lamella. Combinations of fixed and adjustable lamellas within a system for forming a fiber web are also possible. For example, in one embodiment, a primary lamella is fixed and one or more secondary lamellas includes a mechanism for controlling height. In another embodiment, one or more secondary lamellas are fixed and one or more primary lamellas includes a mechanism for controlling height. The fixed or variable height lamellas may be attached, directly or indirectly, to a distributer block, which may allow up and down movement of the lamellas within the flow zone. Other configurations are also possible.

According to one set of embodiments, the height of a lamella (e.g., a primary or secondary lamella) may be varied while one or more fiber mixtures is flowing in the flow zone. The change in height of a lamella may change the flow profile of one or more fiber mixtures flowing in the flow zone, and may affect the degree of mixing between fiber mixtures. Advantageously, in some embodiments, such a process can be used to form different fiber webs having different properties without ceasing fluid flow and/or without stopping a production run. A production run typically involves setting parameters of the system to form a fiber web having a particular set of properties. A first production run may involve, for example, forming a first fiber web having a particular set of properties using a lamella in a first position (e.g., height). Then (e.g., without stopping flow of the fiber mixtures) the position (e.g., height) of the lamella may be changed to a second position suitable for a second production run, i.e., forming a second fiber web having a particular set of properties different from the first fiber web. In some embodiments, these steps may be performed on a continuous basis, e.g., with an automated positioning device. Optionally, a different fiber mixture (e.g., a third fiber mixture) may be introduced into the flow zone before, during, or after changing the height of one or more lamellas.

In other embodiments, adjusting the height of one or more lamellas may be performed on a discontinuous basis, e.g., by shutting down the system, manually (or automatically) adjusting the height of a lamella, and restarting the production run. In certain embodiments, the height of one or more lamellas may be changed before or after a production run. For instance, a first production run may involve using a lamella in a first position involving a first height within the flow zone. The first production run may be ceased (e.g., ceasing flow of the fiber mixtures), and then the height of the lamella may be changed to a second position involving a second height different from the first height. A second production run can then be initiated while the lamella is in the second position.

A lamella (e.g., a primary lamella or a secondary lamella) may have any suitable dimensions. In some embodiments, the lamella has a length of, for example, between about 1 mm and about 2,000 mm (e.g., between about 100 mm and about 500 mm, between about 100 mm and about 1,000 mm, or between about 1,000 mm and about 2,000 mm). The length of the lamella may be, for example, greater than about 1 mm, greater than about 100 mm, greater than about 300 mm, greater than about 500 mm, or greater than about 1,000 mm. In other cases, the length of the lamella is less than about 2,000 mm, less than about 1,000 mm, less than about 500 mm, less than about 300 mm, or less than about 100 mm. The length of the lamella is determined by measuring the absolute length of the lamella. In some instances, the lamella extends from the distributor block to the dewatering system (e.g., an upstream-most vacuum box). In other instances, the lamella extends from the distributor block until the downstream end of the top surface. Other configurations are also possible.

In some embodiments, the length of a secondary lamella is the same as the length of a primary lamella. In other embodiments, the length of a secondary lamella may be greater than, or less than, the length of a primary lamella. In certain embodiments, the length of a secondary lamella is at least 20%, at least 40%, at least 60%, at least 80%, at least 100%, at least 120%, at least 140%, at least 160%, at least 180%, or at least 200% the length of a primary lamella in the system. In other embodiments, the length of a secondary lamella is less than 200%, less than 180%, less than 140%, less than 120%, less than 100%, less than 80%, less than 60%, less than 40%, or less than 20% the length of a primary lamella in the system. Other lengths are also possible.

The width of a lamella (e.g., a primary lamella or a secondary lamella) can vary. Whereas the width of a primary lamella typically extends the width of the flow zone, in some embodiments, the width of a secondary lamella may be less than the width of the flow zone. For example, in some embodiments, the width of a secondary lamella may extend at least 20%, at least 40%, at least 60%, or at least 80%, but less than 100%, of the width of the flow zone. In other embodiments, the width of a secondary lamella may extend less than 80%, less than 60%, less than 40%, or less than 20% of the width of the flow zone. In yet other embodiments, the width of a secondary lamella extends the entire width of the flow zone. In some embodiments, the width of a primary lamella is shorter than the width of the flow zone. Other configurations are also possible.

The thickness of a lamella (e.g., a primary lamella or a secondary lamella) can also vary. For example, the average thickness of the lamella may be between about 1/16" to about 4" (e.g., between about 1/16" to about 1", between about 1" to about 4", between about 1/8" to about 1/4", or between about 1/8" to about 1/6"). In some cases, the average thickness of the lamella is greater than about 1/8", greater than about 1/6", greater than about 1/4", greater than about 1/2", greater than about 1", or greater than about 2". In other cases, the average thickness of the lamella is less than about 2", less than about 1", less than about 1/2", less than about 1/4", less than about 1/6", or less than about 1/8". In yet other embodiments, the thickness of the lamella can vary along the length of the lamella. For example, the thickness of the lamella may taper along its length (e.g., from about 1/4" to about 1/8"). The thickness of a secondary lamella may be greater than, or less than, the thickness of a primary lamella in the system. Other thicknesses are also possible.

A lamella (e.g., a primary lamella or a secondary lamella) can be made of any suitable material. Generally, the materials for the lamella are chosen for their strength and anti-corrosion properties. Examples of suitable materials may include metals (e.g., stainless steel, composite steels), polymers (e.g., soft latex, rubbers, high density polyethylene, epoxy, vinylester, polyester), fiber-reinforced polymers (e.g., using fiberglass, carbon, or aramid fibers), ceramics, and combinations thereof. The lamella may be formed of a single piece of material, or may be formed by combining two or more pieces of materials. Thin layers of metals or ceramics can also be used to form all or portions of a lamella. In some embodiments, combinations of polymers, metals, and/or ceramics can be used. In certain embodiments, a secondary lamella may be formed of a material that is more flexible than a material used to form a primary lamella. Non-limiting examples of flexible materials include polymers such as polyethylene (e.g., linear low density polyethylene and ultra low density polyethylene), polypropylene, polyvinylchloride, polyvinyldichloride, polyvinylidene chloride, ethylene vinyl acetate, polycarbonate, polymethacrylate, polyvinyl alcohol, nylon, latex, silicones, rubbers, and/or other plastics.

As described herein, in some embodiments, a system for forming a fiber web includes one or more flow impediments positioned in a portion of the flow zone for disrupting laminar flow of a fiber mixture in the flow zone and/or fiber web forming zone. An example of a flow impediment is a disruptive member positioned in a portion of a flow zone, as described in more detail below. A method of forming a fiber web may include, in some embodiments, disrupting laminar flow of a fiber mixture in a portion of the flow zone and/or fiber web forming zone using a flow impediment positioned, for example, in the lower portion or upper portion of the flow zone. The flow impediment may facilitate intermixing of the first and second fiber mixtures at a fiber web forming zone, at least a part of which is positioned downstream of flow zone. In certain embodiments, the position and/or configuration of a flow impediment in the flow zone is adjustable, and a control system may be connected to the flow impediment for varying the position and/or configuration of the flow impediment in the flow zone. For example, a control system may be connected to a disruptive member and may be used to control the height, horizontal position, and/or rotational rate of the flow impediment in the flow zone.

As described herein, in some embodiments, a system for forming a fiber web includes a flow impediment positioned in a flow zone for disrupting laminar flow. For example, as shown in the embodiment illustrated in FIG. 3, a flow zone 25, which may be separated into lower portion 45 and upper portion 50 by a lamella 140, may also include a disruptive member 145 (e.g., a roll or a wheel) positioned in the lower portion of the flow zone to disrupt flow of a fiber mixture flowing in the lower portion. Disruptive member 145 may rotate about an axis 147, which may be positioned perpendicular to the general direction of fluid flow in the flow zone. Additionally or alternatively, a disruptive member 150 may be positioned in the upper portion of the flow zone to disrupt laminar flow of a fiber mixture flowing in the upper portion. Disruptive member 150 may rotate about an axis 152, which may be positioned perpendicular to the general direction of fluid flow in the flow zone. The positioning of a disruptive member within a portion of a flow zone can be used to increase the level of turbulence (e.g., non-laminar flow) within a fiber mixture. As described herein, the increase in turbulence in a portion of the flow zone can result in the intermixing between fiber mixtures at a fiber web forming zone. This intermixing may cause the formation of one or more gradients across all or portions of the thickness of the resulting fiber web, as described herein.

In some embodiments, a disruptive member is designed to rotate (i.e., a rotating member). A disruptive member may rotate about an axis in a clockwise direction or in a counter-clockwise direction. In some embodiments, a disruptive member may freely rotate in either direction, and the particular rotational direction and/or rate at a given instance may depend on the flow velocity of the fiber mixture flowing past the disruptive member (including the relative flow velocities of the fiber mixture flowing above, below, and/or through the disruptive member), the position of the disruptive member within the flow zone, the shape of the disruptive member, among other factors. In some embodiments, the rotational direction of a disruptive member is fixed so that it rotates only in a particular direction. In certain embodiments, rotation of a disruptive member is driven at least in part by a motor. For example, a motor may cause the disruptive member to rotate at at least a minimum rotational rate, but the rotational rate may increase depending on the flow velocities of the fiber mixtures flowing past the disruptive member. In yet other embodiments, rotation of a disruptive member is driven completely by a motor. For example, a motor may cause the disruptive member to rotate at a particular rate regardless of the flow velocity of fiber mixtures flowing past the disruptive member. In some embodiments, the direction and/or rate of a disruptive member may be controlled using a control system, as described in more detail below. In other embodiments, a disruptive member may be fixed in a stationary position.

A disruptive member that is configured to rotate may rotate at any suitable rate. For example, a disruptive member may rotate at a rate of between 0 and about 3,500 revolutions per minute (rpm) in either direction (e.g., between about 0 rpm and about 500 rpm, between about 100 and 500 rpm, between about 0 rpm and 1,000 rpm). In some embodiments, a disruptive member may rotate at a rate of greater than about 5 rpm, greater than about 50 rpm, greater than about 100 rpm, greater than about 300 rpm, greater than about 500 rpm, or greater than about 1,000 rpm. In other embodiments, a disruptive member may rotate at a rate of less than about 1,000 rpm, less than about 500 rpm, less than about 300 rpm, less than about 100 rpm, or less than about 50 rpm. Other rotational rates are also possible. As described herein, the rotational rate may be controlled at least in part by a motor and/or by the flow velocity of the fiber mixtures flowing past the disruptive member.

A disruptive member positioned in a flow zone may have any suitable shape. Different shapes of the disruptive member may be used depending on, for example, the level of turbulence desired. In some embodiments, a disruptive member is cylindrical. For example, the disruptive member may be a roll or a wheel. In other embodiments, a disruptive member may be substantially flat. In certain embodiments, a disruptive member has a cross-section in the shape of a circle, oval, triangle, square, rectangle, pentagon, hexagon, heptagon, octagon, symmetric or asymmetric polygons, etc. A cross-section of a disruptive member may have any suitable number of sides (e.g., 3, 4, 5, 6, 7, 8, etc. sides). The disruptive member may be solid surface that does not permit a fiber mixture to flow through it, or it may contain drilled holes or other types of openings to allow flow through the surface of the disruptive member. In other embodiments, a disruptive member may include an axis with blades protruding outward from the axis. Other shapes and configurations are also possible.

Figure 3:
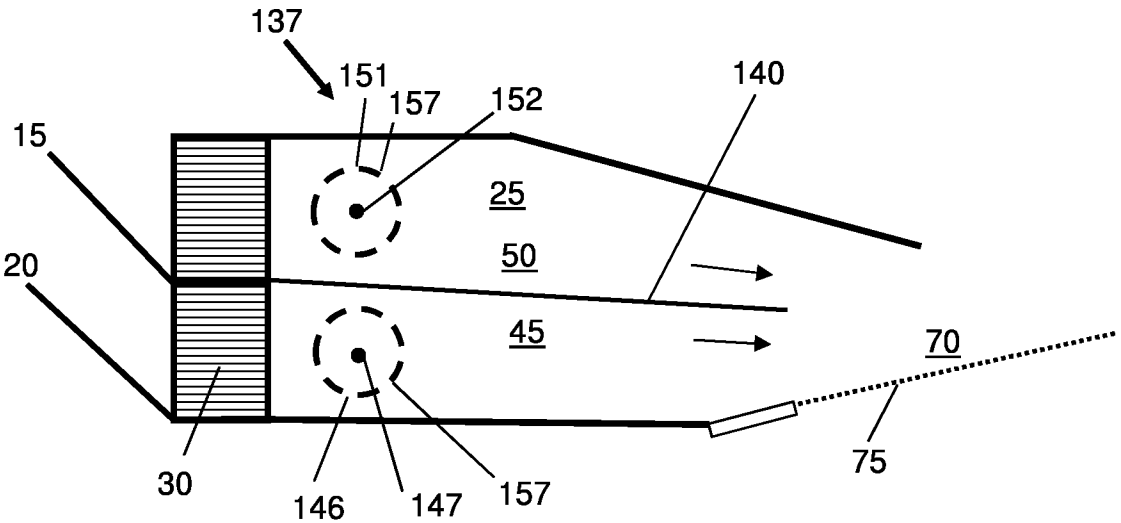
FIG. 3 is a schematic diagram showing a system for forming a fiber web including disruptive members positioned in the flow zone according to one set of embodiments.

As shown illustratively in FIG. 3, in some embodiments, disruptive members 145 and 150 may include one or more openings 157 that allow a fiber mixture to flow through the disruptive member (e.g., from an upstream portion to a downstream portion of the disruptive member). The presence of one or more openings in a disruptive member may be used to decrease or increase the level of turbulence created in the flow zone (e.g., depending on the positioning, size, and shape of the one or more openings). The openings may be in the form of slots, drilled holes, or other suitable configurations.

A disruptive member may have any suitable size. For example, the height of a disruptive member may be, for example, between about 25 mm and about 2,000 mm (e.g., between about 25 mm and about 500 mm, between about 500 mm and about 1,000 mm, or between about 1,000 and about 2,000 mm). In some cases, the height of a disruptive member may be greater than about 25 mm, greater than about 200 mm, greater than about 500 mm, greater than about 1,000 mm, or greater than about 1,500 mm. In other cases, the height of a disruptive member may be less than about 2,000 mm, less than about 1,500 mm, less than about 1,000 mm, less than about 500 mm, or less than about 200 mm. Other value are also possible.

In some cases, the width of a disruptive member may be, for example, between about 500 mm and about 12,500 mm (e.g., between about 6,000 mm and about 12,500 mm, between about 500 mm and about 6,000 mm, or between about 3,000 and about 9,000 mm). In some instances, a width of the disruptive member is substantially similar to the width of the top and/or bottom surfaces of the system. In some embodiments, the width of the disruptive member may be, for example, greater than about 200 mm, greater than about 500 mm, greater than about 1,000 mm, greater than about 3,000 mm, greater than about 6,000 mm, or greater than about 9,000 mm. In other embodiments, the width of the disruptive member may be, for example, less than about 12,500 mm, less than about 9,000 mm, less than about 6,000 mm, less than about 3,000 mm, or less than about 1,000 mm, or less than about 500 mm. Other widths of a disruptive member are also possible.

In certain embodiments, the height or width of a disruptive member is at least 20%, at least 40%, at least 60%, or at least 80% of the height or width, respectively, of the portion of the flow zone in which the disruptive member is positioned (e.g., an upper or lower portion of the flow zone). In some embodiments, the height or width of a disruptive member is less than 80%, less than 60%, less than 40%, or less than 20% of the height or width of the portion of the flow zone in which the disruptive member is positioned. Other sizes are also possible.

A disruptive member may be formed of any suitable material. Examples of suitable materials may include metals (e.g., stainless steel), polymers (e.g., soft latex, rubbers, high density polyethylene, polytetrafluoroethylene), fiberglass, ceramics, and combinations thereof. The disruptive member may be formed of a single piece of material, or may be formed by combining two or more pieces of materials. In certain embodiments, a disruptive member may be formed of a flexible material. Non-limiting examples of flexible materials include polymers such as polyethylene (e.g., linear low density polyethylene and ultra low density polyethylene), polypropylene, polyvinylchloride, polyvinyldichloride, polyvinylidene chloride, ethylene vinyl acetate, polycarbonate, polymethacrylate, polyvinyl alcohol, nylon, latex, silicones, rubbers, and/or other plastics.

A disruptive member may be attached to any suitable portion of a system for forming a fiber web. For example, in some embodiments, a disruptive member may be attached to a threaded rod positioned vertically within a portion of the flow zone. In some embodiments, a disruptive member may be attached to a distributor block. In other embodiments, a disruptive member may be attached to a top surface and/or a bottom surface, and/or the sides of the flow zone. Combinations of such attachments are also possible. In certain embodiments, attachment involves the use of adhesives, fasteners, metallic banding systems, railing mechanisms, interlocking drive mechanisms (e.g., magnetic, belt, or direct driven) or other support mechanisms. Other attachment mechanisms are also possible.

Although a single disruptive member is positioned within each of the lower and upper portions of the flow zone in the embodiment illustrated in FIG. 3, in other embodiments, additional disruptive members can be positioned in a portion of a flow zone to disrupt laminar flow in that flow zone. For example, in some embodiments, 2, 3, 4, 5, etc. disruptive members can be positioned within a flow zone to disrupt laminar flow. Multiple disruptive members may be positioned vertically, horizontally, and/or diagonally with respect to one another, and/or with respect to the diffuser block. Furthermore, although FIG. 3 shows a disruptive member in each of lower and upper portions of the flow zone, in other embodiments, one of disruptive members 145 or 150 may be absent.

In yet other embodiments, a flow zone may be configured to receive a third fiber mixture, and the system may include a second lamella that separates the flow zone into three main portions. The second lamella may be positioned to divide the third fiber mixture from the first and/or second fiber mixtures in the flow zone. Optionally, one or more disruptive members may be positioned in one or more of the three portions of the flow zone to disrupt laminar flow. Similarly, additional fiber mixtures (e.g., 4, 5, 6, etc., fiber mixtures) may be added with concurrent additional lamellas and disruptive members as desired. Other configurations are also possible.

A disruptive member may be positioned at any suitable position within a portion of a flow zone. For example, although each of disruptive members 145 and 150 in FIG. 3 is positioned within the center of the lower and upper portions of the flow zone, respectively, in other embodiments a disruptive member may be positioned higher or lower as desired. Additionally, although FIG. 3 shows each of disruptive members 145 and 150 being positioned near an upstream end of the flow zone, in other embodiments, one or more disruptive members may be positioned at a downstream end of the flow zone, or between an upstream end and a downstream end of the flow zone. Other positions and combinations of positions are also possible.

In some embodiments, the position and/or configuration of a disruptive member is adjustable within the flow zone. For example, in one set of embodiments, the position of a disruptive member with respect to the height and/or length of a portion of the flow zone may be adjustable. In other embodiments, a configuration of the disruptive member, such as rotational direction or rotational rate of the disruptive member, may be adjustable. In yet other embodiments, the angle of the disruptive member within the flow zone may be adjustable. The position and/or configuration of a disruptive member within a portion of a flow zone may be varied to control the degree of turbulence in that portion of the flow zone and/or at a fiber web forming zone. For example, in one embodiment, the angle of installation from one end of the disruptive member to the other, e.g., front to back, in the flow zone may be adjusted to achieve different effects on flow (e.g., level of turbulence).

A variety of control systems, including mechanisms, for controlling the position and/or configuration of a disruptive member in a flow zone can be implemented. For example, in one embodiment a control system may include an adjustment wheel which may be connected to a disruptive member to allow control of the position of the disruptive member within the flow zone. In another embodiment, a servomechanism can be used. In certain embodiments, a disruptive member is connected to a motor (e.g., an electric motor) which can allow adjustments of the position and/or configuration of the disruptive member. In certain embodiments, a control system may include mechanical, electromechanical, hydraulic, pneumatic or magnetic systems that can be used to control a position and/or configuration. All or portions of the control system/mechanism may extend outside of the flow zone in some embodiments, and may be either manually or automatically controlled. Combinations of different mechanisms and/or control systems can also be used. Other mechanisms and configurations for controlling a position and/or configuration of a disruptive member are also possible.

In some embodiments, a disruptive member includes a control system or mechanism for controlling position and/or configuration that is electronically controlled. Adjustments of position and/or configuration of a disruptive member may be controlled by the control system and may take place automatically by, for example, an automated control system and/or may be controlled by input from a user. In some embodiments, instructions for adjusting the position and/or configuration of a disruptive member are pre-programmed into the control system, e.g., prior to initiating a production run. The one or more control systems can be implemented in numerous ways, such as with dedicated hardware and/or firmware, using a processor that is programmed using microcode or software to perform the functions described herein. In some embodiments, control of the position and/or configuration of one or more disruptive members involves the use of sensors and/or negative or positive feedback (e.g., using a servomechanism). A control system can be used to adjust the position and/or configuration of several disruptive members (e.g., simultaneously or alternately) in some embodiments.

Where more than one disruptive members are present, the position and/or configuration of the disruptive members may be controlled independently of one another. For instance, the position and/or configuration of the disruptive members may be controlled independently such that each of the positions and/or configurations of the disruptive members can change depending on its location in the flow zone, the amount of fluid and/or pressure in the flow zone, the type of fiber mixture(s) in the flow zone, the amount of turbulence desired, and/or other conditions. For example, in one embodiment in which a lower portion of a flow zone includes a disruptive member and an upper portion of the flow zone includes another disruptive member, the flow profiles in each of the lower and upper portions of the flow zone can be modified independently by varying the respective positions and/or configurations of the disruptive members.

According to one set of embodiments, the position and/or configuration of a disruptive member may be varied while one or more fiber mixtures is flowing in the flow zone. The change in position and/or configuration of a disruptive member may change the flow profile of one or more fiber mixtures flowing in the flow zone, and may affect the degree of mixing between fiber mixtures. Advantageously, in some embodiments, such a process can be used to form different fiber webs having different properties without ceasing fluid flow and/or without stopping a production run. A production run typically involves setting parameters of the system to form a fiber web having a particular set of properties. A first production run may involve, for example, forming a first fiber web having a particular set of properties using a disruptive member in a first position and/or configuration. Then (e.g., without stopping flow of the fiber mixtures), the position and/or configuration of the disruptive member may be changed to a second position and/or configuration suitable for a second production run, i.e., forming a second fiber web having a particular set of properties different from the first fiber web. In some embodiments, these steps may be performed on a continuous basis, e.g., with an automated disruptive member speed control/positioning device. Optionally, a different fiber mixture (e.g., a third fiber mixture) may be introduced into the flow zone before, during, or after changing the position and/or configuration of one or more disruptive members.

In other embodiments, adjusting the position and/or configuration of a disruptive member may be performed on a discontinuous basis, e.g., by shutting down the system, manually (or automatically) adjusting the disruptive member rotational speed/positioning, and restarting the production run. In certain embodiments, the position and/or configuration of one or more disruptive members may be changed before or after a production run. For instance, a first production run may involve using a disruptive member in a first position involving a first position and/or configuration within the flow zone. The first production run may be ceased (e.g., ceasing flow of the fiber mixtures), and then the position and/or configuration of the disruptive member may be changed to a second position involving a second position and/or configuration different from the first position and/or configuration. A second production run can then be initiated while the disruptive member is in the second position.

As described herein, in some embodiments, a system for forming a fiber web includes one or more flow impediments positioned in a portion of the flow zone for disrupting laminar flow of a fiber mixture in the flow zone or fiber web forming zone. An example of a flow impediment is a lamella having a textured surface that disrupts laminar flow, as described in more detail below. A method of forming a fiber web may include, in some embodiments, disrupting laminar flow of a fiber mixture in the flow zone or fiber web forming zone using a flow impediment positioned in, for example, the lower portion or upper portion of the flow zone. The flow impediment may facilitate intermixing of the first and second fiber mixtures at a fiber web forming zone, at least a part of which is positioned downstream of flow zone.

As described herein, in some embodiments, at least a portion of lamella surface (e.g., a surface of a primary lamella and/or a secondary lamella) may be textured. A textured surface may include a plurality of features, each having a non-zero lateral dimension (e.g., width, diameter, or length) and a non-zero depth or height. The features may be in the form of, for example, protrusions and/or indentations. Examples of textured surfaces are shown in the embodiments illustrated in FIGS. 4A-4D. FIGS. 4A-4C show cross-sectional views of portions of lamellas having textured surfaces, and FIG. 4D shows a top view of a portion of a lamella having a textured surface.

Figures 4A, 4B, 4C, 4D:
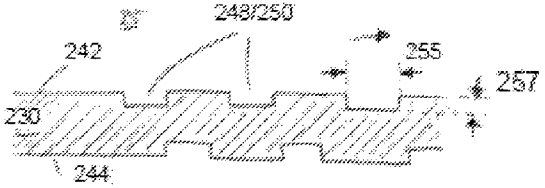
FIGS. 4A-4D are schematic diagrams showing examples of lamellas having textured surfaces according to one set of embodiments.

As shown illustratively in FIG. 4A, a lamella 230 (e.g., a primary or secondary lamella, only a portion of which is shown) may include a top surface 242 and a bottom surface 244. The top and/or bottom surface may include one or more non-textured surface portions 245, and one or more textured surface portions 246. In other embodiments, the entire surface may include textured portions. The textured surface portions may include a plurality of features 248, which, in some embodiments, may be in the form of indentations 250 into a surface of the lamella. The features may have a width 255 and a depth 257. As shown illustratively, the features may cause portions of the lamella to vary in thickness across a length (or width) of the lamella.

In other embodiments, the features of a textured surface may be in the form of protrusions. For example, as shown illustratively in FIG. 4B, a lamella 231 (e.g., a primary or secondary lamella) may include a plurality of protrusions 260 having a width 255 and a height 258. In yet other embodiments, a textured surface may include a combination of indentations and protrusions, as shown in a lamella 232 of FIG. 4C.

As shown illustratively in the figures, the features of a textured surface do not protrude through the entire thickness of the lamella (e.g., from the top surface to the bottom surface). As such, the features of a textured surface typically have a base, and do not allow fluid communication between the lower and upper portions of the flow zone across the thickness of the lamella.

The features shown in FIGS. 4A-4C may be positioned at an upstream end of the lamella (e.g., in an upstream portion of the flow zone), at a downstream end of the lamella (e.g., in a downstream portion of the flow zone), or between an upstream end and a downstream end of the lamella (e.g., between upstream and downstream portions of the flow zone). In other cases, the entire length and/or width of a lamella may include one or more sets of features.

As shown illustratively in FIG. 4A-4D, the features of a textured surface may have different shapes (e.g., cross-sectional shapes, as shown in FIGS. 4A-4C, or shapes viewing from above, as shown in FIG. 4D). In certain embodiments, one or more features may be in the shape of a circle, semicircle, oval, arc, triangle, square, rectangle, etc. The shape of a feature may be smooth (e.g., without edges), in some embodiments, to minimize the catching of fibers during flow. In some cases, the features are in the form of lines or grids. In other embodiments, one or more features may have a sawtooth herringbone configuration. A feature may have any suitable number of sides (e.g., 1, 2, 3, 4, 5, 6, 7, 8, etc. sides). In other embodiments, the shape of a feature is symmetric; in other embodiments, the shape of a feature is asymmetric. In some embodiments, the shape or size of a feature may be substantially the same along a width or length of a lamella, whereas in other embodiments, the shape or size of a feature may change along the width or length of the lamella. A feature may have a main axis of orientation (e.g., a length), which may be aligned or not aligned with the direction of fluid flow, as described in more detail below. Other shapes and configurations are also possible.

The features of a textured surface may be oriented at any suitable orientation with respect to the direction of fluid flow. The particular orientation of features may be chosen depending on the level of disruption of laminar flow (e.g., level of turbulence) desired. As shown illustratively in FIG. 4D (a top view), a lamella 233 (e.g., a primary or secondary lamella) may optionally include a first set of features 262 having a main axis (e.g., length) oriented substantially parallel to the direction of fluid flow (which is shown by the arrow). Optionally, the lamella may include a second set of features 264 having a main axis oriented substantially perpendicular to the direction of fluid flow. Optionally, the lamella may include a third set of features 266 having a main axis oriented at an angle with respect to the direction of fluid flow. In some embodiments, a set of features has a shape that differs along a width and/or length of the lamella, such as fourth and fifth sets of features 268 and 270. Features may be oriented in a pattern, like a sixth set of features 272, or they may be randomly oriented. It should be appreciated that a lamella need not include all such sets of features, and in other embodiments, may include only one of the aforementioned sets of features, or various combinations of other features.

Furthermore, although FIG. 4D shows an upstream portion of a lamella having different features or a different orientation of features than those at a downstream portion of the lamella, in other embodiments the upstream and downstream portions of a lamella may have the same set of features or orientation of features. In other embodiments, a textured surface is designed such that an upstream portion of the lamella may have a first set of features that disrupts laminar flow more (or less) than the features present at a downstream portion. In some cases, a lamella may include a series of features that exhibit a gradient in the features' ability to disrupt laminar flow across the length of the lamella, as described in more detail below. In yet other embodiments, the orientation or types of features may vary across a width of the lamella. Other configurations are also possible.

As shown in FIGS. 4A-4C, a lamella may have both non-textured portions 245 and textured portions 246 in some embodiments. The proportions of the areas of the non-textured portions and textured portions on a top and/or bottom surface of a lamella may vary. For example, in some embodiments, at least 1%, at least 5%, at least 10%, at least 20%, at least 30%, at least 40%, at least 50%, at least 60%, at least 70%, at least 80%, or at least 90% of the area of a top and/or bottom surface of a lamella includes textured portions. In certain embodiments, the entire surface (e.g., top and/or bottom surface) of a lamella is textured. In some embodiments, less than 90%, less than 80%, less than 70%, less than 60%, less than 30%, less than 20%, less than 10%, or less than 5% of the area of a top and/or bottom surface of a lamella includes textured portions. An area of a textured portion may be determined by measuring the rectangular area bound by the outermost points of the features of the textured portion along each axis, e.g., as shown by the dashed lines in FIG. 4D with respect to set of features 270.

The proportion of a surface of a lamella that is in the form of features can also vary. For example, in some embodiments, at least 1%, at least 5%, at least 10%, at least 20%, at least 30%, at least 40%, at least 50%, at least 60% or at least 70% of the area of a top and/or bottom surface of a lamella is in the form of features. In some embodiments, less than 70%, less than 60%, less than 30%, less than 20%, less than 10%, or less than 5% of the area of a top and/or bottom surface of a lamella is in the form of features. The proportion of a surface of a lamella that is in the form of features is measured by taking the sum of the areas of the features. For example, for a textured surface having a plurality of indentations, the area of the indentations is measured and divided by the total area of the lamella surface.

The lateral dimensions of a feature of a textured surface may vary as desired. The lateral dimension may be, for example, a width, diameter, or length of the feature. In some cases, a feature has at least two lateral dimensions, such as a relatively larger lateral dimension (e.g., a length) and a relatively smaller lateral dimension (e.g., a width). For example, each of the features in set of features 264 shown in FIG. 4D has relatively larger lateral dimension in the form of a length 259 and relatively smaller lateral dimension in the form of a width 261. In other embodiments, a feature includes a single lateral dimension (e.g., a diameter). For example, each of the features in set of features 272 may have a diameter 263. A lateral dimension of a feature may range, for example, between about 1 mm and about 13,000 mm (e.g., between about 1 mm and about 50 mm, between about 50 mm and about 100 mm, between about 100 mm and about 500 mm, between about 500 mm and about 1,000 mm, between about 1,000 mm and about 5,000 mm, or between about 5,000 mm and about 13,000 mm). In some embodiments, the lateral dimension of a feature is at least about 10 mm, at least about 50 mm, at least about 100 mm, at least about 500 mm, at least about 1,000 mm, at least about 2,500 mm, at least about 5,000 mm, at least about 7,000 mm, or at least about 10,000 mm. In other embodiments, the lateral dimension of a feature is less than about 13,000 mm, less than about 10,000 mm, less than about 7,000 mm, less than about 5,000 mm, less than about 2,500 mm, less than about 2,000 mm, less than about 1,000 mm, less than about 500 mm, less than about 100 mm, or less than about 50 mm. Other lateral dimensions are also possible.

The height or depth of a feature of a textured surface may vary as desired. The height or depth of a feature may be, for example, between about 1 mm and about 1,000 mm (e.g., between about 1 mm and about 50 mm, between about 50 mm and about 100 mm, between about 100 mm and about 500 mm, or between about 500 mm and about 1,000 mm. In some embodiments, the height or depth of a feature is at least about 10 mm, at least about 50 mm, at least about 100 mm, at least about 250 mm, at least about 500 mm, at least about 750 mm, or at least about 1,000 mm. In other embodiments, the height or depth of a feature is less than about 1,000 mm, less than about 750 mm, less than about 500 mm, less than about 250 mm, less than about 100 mm, less than about 50 mm, or less than about 10 mm. Other heights or depths are also possible.

A textured lamella surface may be formed of any suitable material. Examples of suitable materials may include metals (e.g., stainless steel), polymers (e.g., soft latex, rubbers, high density polyethylene), ceramics, and combinations thereof. In some embodiments, a textured portion of a lamella surface is formed of the same material as a non-textured portion of the surface, or as an interior (e.g., non-surface) portion of the lamella. For example, a textured surface may be formed by drilling features into a lamella surface. In another example, a lamella may be formed with surface features in a single process such as by injection molding. In other embodiments, a textured portion of a lamella surface may be formed of a different material than a non-textured portion of the surface. For example, all or portions of a lamella (e.g., at least 20%, at least 40%, at least 60%, or at least 80% of a lamella surface) may be coated with a material to form a textured surface. A textured surface portion may be formed of a single piece of material, or may be formed by combining two or more pieces or combinations of materials. In certain embodiments, at least a portion of a textured surface may be formed of a flexible material. Non-limiting examples of flexible materials include polymers such as polyethylene (e.g., linear low density polyethylene and ultra low density polyethylene), polypropylene, polyvinylchloride, polyvinyldichloride, polyvinylidene chloride, ethylene vinyl acetate, polycarbonate, polymethacrylate, polyvinyl alcohol, nylon, latex, silicones, rubbers, and/or other plastics.

Features of a textured surface may be formed using any suitable technique. For example, features may be formed by drilling, casting, injection molding, blow molding, extrusion, coating, or gluing. Other methods for forming a textured surface are also possible.

In some embodiments described herein, a system for forming a fiber web includes one or more flow impediments positioned in a portion of the flow zone for disrupting laminar flow of a fiber mixture in the flow zone and/or fiber web forming zone. An example of a flow impediment is a variable volume member associated with a lamella, as described in more detail below. A method of forming a fiber web may include, in some embodiments, disrupting laminar flow of a fiber mixture in a portion of the flow zone using a flow impediment positioned in the flow zone. The flow impediment may facilitate intermixing of the first and second fiber mixtures at a fiber web forming zone, at least a part of which is positioned downstream of flow zone. In certain embodiments, the position and/or configuration of the lamella in the flow zone is adjustable, and a control system may be connected to the lamella for varying the position and/or configuration of the lamella in the flow zone. For example, a control system may be connected to a variable volume member of a lamella and may be used to control expansion and contraction of the variable volume member.

In one set of embodiments, a lamella includes at least one variable volume member that can be expanded and contracted to effectively modify the internal volume of at least a portion of the lamella. Expansion or contraction of the variable volume member may also cause all or portions of the lamella to change its shape. The modified volume and/or shape of the lamella can be used to change the flow profiles of the fiber mixtures flowing above and/or below the lamella in the flow zone, and/or the fiber mixtures flowing in the fiber web forming zone as described herein.

Figure 5A:
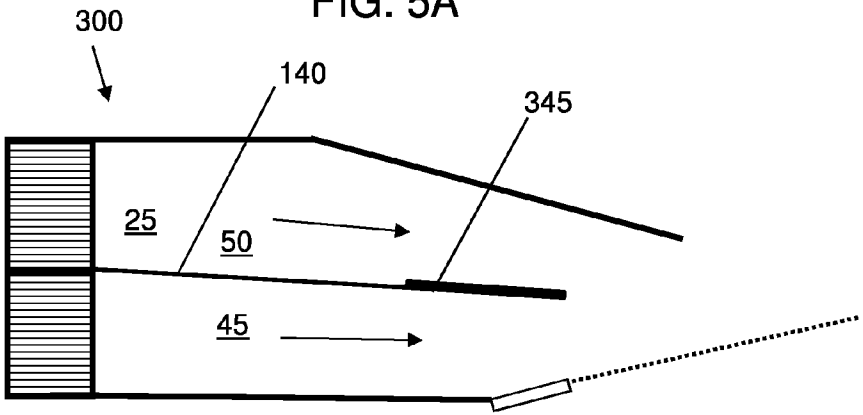
FIGS. 5A-5D are schematic diagrams showing a system for forming a fiber web including a lamella having a variable volume member attached thereto according to one set of embodiments.
Figure 5B:
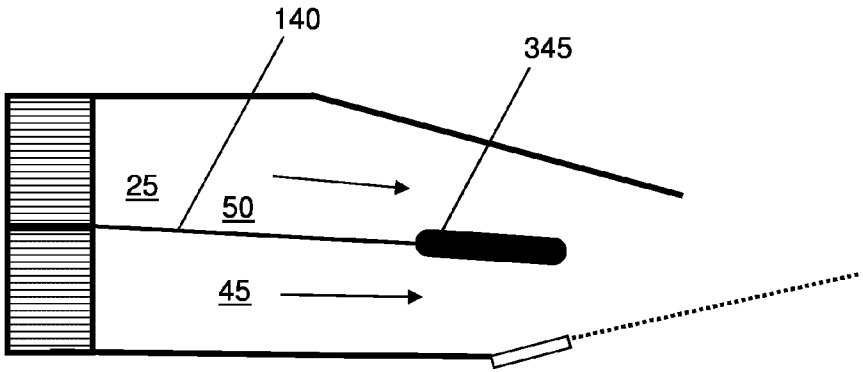
Figure 5C:
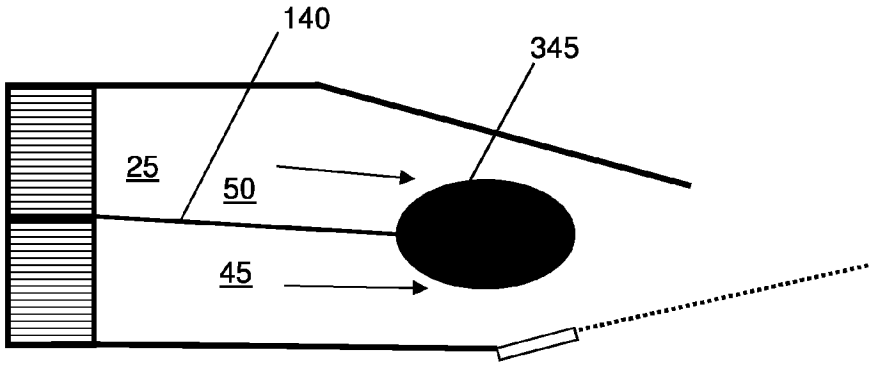
Figure 5D:
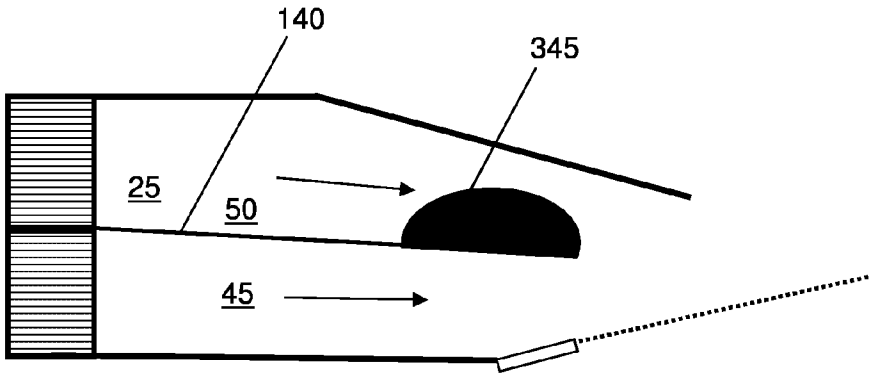
Figure 6A:
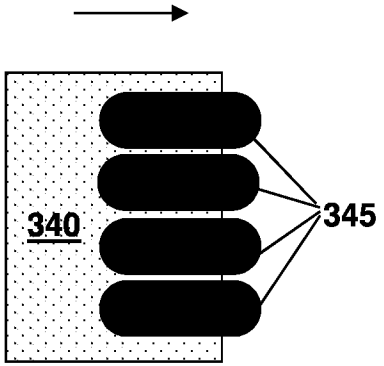
FIGS. 6A-6C are top views of lamellas including variable volume members according to one set of embodiments.
Figure 6B:
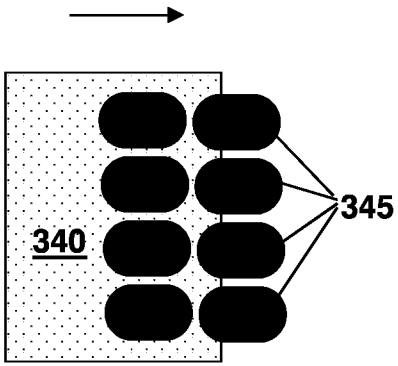
Figure 6C:
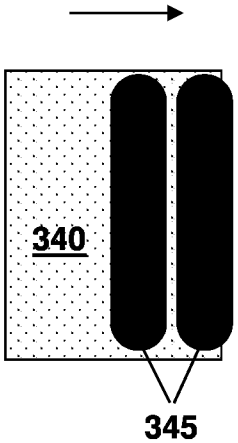

An example of a lamella having a variable volume member is shown in the embodiments illustrated in FIGS. 5A-5D. Lamella 140 may include a variable volume member 345 positioned at a downstream end of the lamella. In FIG. 5A, the variable volume member is in a contracted configuration; in FIGS. 5B-5D, the variable volume member is in an expanded configuration. FIG. 5B shows the variable volume member in a partially expanded configuration, and FIG. 5C shows the variable volume member in a fully expanded configuration. It should be appreciated that although a single variable volume member is shown in the lamella illustrated in FIGS. 5A-5D, in other embodiments, a lamella may include more than one variable volume members (e.g., at least 2, 3, 4, 5, etc. variable volume members). Moreover, while FIGS. 5A-5D show a primary lamella including a variable volume member, in other embodiments, a secondary lamella may include one or more variable volume members. Additionally, variable volume member 345 may be positioned at any suitable position with respect to other portions of the lamella, and/or with respect to the flow zone. For example, in some cases, a variable volume member may be positioned at an upstream end of the lamella (e.g., in an upstream portion of the flow zone), or between an upstream end and a downstream end of the lamella (e.g., between upstream and downstream portions of the flow zone). In other cases, the entire length and/or width of a lamella may include one or more variable volume members. In some embodiments, a variable volume member is configured to expand into only one portion of a flow zone, as shown illustratively in FIG. 5D.

Where more than one variable volume members are present, the variable volume members may be positioned at any suitable position with respect to one another. For example, in some embodiments, two or more variable volume members are positioned along-side one another (e.g., parallel, or non-parallel to one another) in the flow direction. Examples of such configurations are shown in FIGS. 6A and 6B, top views of lamellas including variable volume members, in which multiple variable volume members 345 are positioned parallel to one another in the flow direction (direction of the arrow). The lamellas shown in FIGS. 6A and 6B may be primary lamellas or secondary lamellas as described herein. In other embodiments, two or more variable volume members are positioned along-side one another (e.g., parallel, or non-parallel to one another) perpendicular or at an angle with respect to the flow direction, e.g., as shown illustratively in FIG. 6C. In yet other embodiments, variable volume members may be positioned facing different portions of the flow zone. For instance, a first variable volume member may be positioned facing a lower portion of the flow zone (e.g., so as to expand into the lower portion), and a second variable volume member may be positioned facing an upper portion of the flow zone (e.g., so as to expand into the upper portion as in FIG. 5D). Other configurations of variable volume members are also possible.

Where more than one variable volume members are present, the variable volume members may be operated independently of one another. For instance, the variable volume members may be controlled independently such that each of the variable volume members can expand or contract depending on its location in the flow zone, the amount of fluid and/or pressure in the flow zone, the amount of turbulence desired, and/or other conditions. For example, in one embodiment in which a lamella includes a first variable volume member positioned facing a lower portion of the flow zone, and a second variable volume member positioned facing an upper portion of the flow zone, the flow profiles in each of the lower and upper flow zones can be modified independently by varying the respective volumes of the variable volume members. In embodiments in which two or more variable volume members of a lamella are operated independently of one another, the two or more variable volume members may not be in fluid communication with one another.

In other embodiments, two or more variable volume members of a lamella are in fluid communication with one another. For example, the increase in volume of a first variable volume member may cause all or portions of a second variable volume member to increase in volume. In other instances, a decrease in volume of a first variable volume member may cause all or portions of a second variable volume member to decrease in volume. Other configurations are also possible.

The variable volume member, or a series of variable volume members, may have any suitable size upon expansion and/or contraction. A variable volume member (or a series of variable volume members) may have a width of, for example, between about 500 mm and about 12,500 mm (e.g., between about 6,000 mm and about 12,500 mm, between about 500 mm and about 6,000 mm, or between about 3,000 and about 9,000 mm) in an expanded or contracted state. The width of the variable volume member is measured perpendicular to the general direction of fluid flow (e.g., in the cross-machine direction). In some embodiments, the width of the variable volume member (or series of variable volume members) may be, for example, greater than about 200 mm, greater than about 500 mm, greater than about 1,000 mm, greater than about 2,000 mm, greater than about 3,000 mm, greater than about 6,000 mm, or greater than about 9,000 mm. In other embodiments, the width of the variable volume member (or series of variable volume members) may be, for example, less than about 12,500 mm, less than about 9,000 mm, less than about 6,000 mm, less than about 3,000 mm, or less than about 1,000 mm, or less than about 500 mm. Other dimensions are also possible.

The variable volume member (or a series of variable volume members) in its contracted and/or expanded state may have a length of, for example, between about 1 mm and about 2,000 mm (e.g., between about 100 mm and about 500 mm, between about 100 mm and about 1,000 mm, or between about 1,000 mm and about 2,000 mm). The length of the variable volume member is measured parallel to the general direction of fluid flow (e.g., in the machine direction). The length of the variable volume member (or a series of variable volume members) may be, for example, greater than about 1 mm, greater than about 100 mm, greater than about 300 mm, greater than about 500 mm, or greater than about 1,000 mm. In other cases, the length of the variable volume member (or a series of variable volume members) is less than about 2,000 mm, less than about 1,000 mm, less than about 500 mm, less than about 300 mm, or less than about 100 mm. Other dimensions are also possible.

A variable volume member (or a series of variable volume members) may have a height of, for example, between about 10 mm and about 2,000 mm (e.g., between about 10 mm and about 500 mm, between about 500 mm and about 1,000 mm, or between about 1,000 mm and about 2,000 mm) in an expanded or contracted state. In some cases, a height of a variable volume member (or a series of variable volume members) may be greater than about 10 mm, greater than about 200 mm, greater than about 500 mm, greater than about 700 mm, greater than about 1,000 mm, greater than about 1,500 mm in an expanded or contracted state. In other cases, a height of a variable volume member (or a series of variable volume members) may be less than about 2,000 mm, less than about 1,500 mm, less than about 1,000 mm, less than about 500 mm, or less than about 200 mm in an expanded or contracted state. Other dimensions are also possible.

In some embodiments, the variable volume member, or a series of variable volume members, has a size in its fully contracted configuration such that it has the same or similar dimensions as other (e.g., non-expandable) portions of the lamella. In some instances, the variable volume member in its fully contracted configuration may be contiguous with one or more other portions of the lamella which does not include a variable volume member. For example, in its fully contracted configuration, the variable volume member may have a height or thickness such that the lamella appears to have a uniform thickness between the variable volume and non-variable volume portions of the lamella. In some instances, a cross-sectional dimension (e.g., a width, diameter, or height) of the variable volume member is substantially similar to the corresponding dimension of the top and/or bottom surfaces of the system. For example, the variable volume may have the same width as that of the top and/or bottom surface in an expanded or contracted configuration.

In some embodiments, upon expansion of the variable volume member, or a series of variable volume members, at least 10%, at least 20%, at least 40%, at least 60%, or at least 80% the height of the flow zone may be obstructed.

Upon expansion or contraction, the volume (e.g., internal volume) of the variable volume member, or a series of variable volume members, may vary, for example, between about 0 $cm^3$ and about 35 $m^3$ (e.g., between about 0 $cm^3$ and about 10 $cm^3$, between about 10 $cm^3$ and about 1 $dm^3$, between about 1 $dm^3$ and about 1 $m^3$, between about 1 $m^3$ and about 10 $m^3$, or between about 10 $m^3$ and about 35 $m^3$). In some embodiments, the volume of the variable volume member may be greater than about 0 $cm^3$, greater than about 10 $cm^3$, greater than about 1 $dm^3$, greater than about 1 $m^3$, or greater than about 10 $m^3$. In other embodiments, the volume of the variable volume member may be less than about 35 $m^3$, less than about 10 $m^3$, less than about 1 $m^3$, less than about 1 $dm^3$, or less than about 10 $cm^3$. Other volumes are also possible.

Upon expansion or contraction, the volume of the variable volume member may increase or decrease by, for example, at least 1.5 times, at least 2 times, at least 3 times, at least 5 times, at least 10 times, at least 20 times, at least 50 times, at least 100 times, at least 200 times, at least 500 times, or at least 1,000 times compared to the initial state.

In certain embodiments, the thickness of a portion of a variable volume may change by at least 1.2 times, at least 1.5 times, at least 2 times, at least 3 times, at least 5 times, at least 10 times, at least 20 times, at least 50 times, at least 100 times, at least 200 times, at least 500 times, or at least 1,000 times upon expansion or contraction of the variable volume member.

The variable volume member may have any suitable shape upon full or partial expansion and/or full or partial contraction. The cross-sectional shape of a variable volume member may be, for example, symmetric, asymmetric, tubular, spherical, oval-shaped, ovate, or flat. In some embodiments, the shape of the variable volume (e.g., upon full or partial expansion, or upon full or partial contraction), may cause it to increase the amount of turbulent flow in the flow zone and/or fiber web forming zone.

In certain embodiments, a variable volume member has excellent recovery, e.g., from an expanded state to a non-expanded state. For instance, in one set of embodiments, after expanding a variable volume member it may be possible to contract the member such that it returns to its original shape and/or has substantially similar dimensions prior to expansion.

A variable volume member may include within its volume a fluid such as a gas or a liquid, or other suitable materials such as foams. Examples of gases include air, oxygen, carbon dioxide, nitrogen, and mixtures thereof. The gases may be compressed or pumped in some embodiments. In some embodiments, liquids such as water can be included in the volume of a variable volume member. Contraction of the variable volume member can take place, for example, by removing all or portions of a substance from the variable volume member (e.g., by deflating or draining a fluid from the variable volume member). Expansion of the variable volume member can take place, for example, by adding one or more substances to the variable volume member (e.g., by inflating or filling the variable volume member with fluid).

All or portions (e.g., greater than 20%, greater than 50%, or greater than 70% by weight) of a variable volume member may be formed of a suitable flexible material. Non-limiting examples of flexible materials include polymers such as polyethylene (e.g., linear low density polyethylene and ultra low density polyethylene), polypropylene, polyvinylchloride, polyvinyldichloride, polyvinylidene chloride, ethylene vinyl acetate, polycarbonate, polymethacrylate, polyvinyl alcohol, nylon, latex, silicones, rubbers (e.g., a synthetic rubber such as ethylene propylene diene monomer (M-class) rubber), and/or other plastics. In some embodiments, portions (e.g., greater than 20%, greater than 50%, or greater than 70% by weight) of the variable volume member may be formed of a substantially rigid material such as a rigid polymer (e.g., high density polyethylene), metal (e.g., stainless steel), a ceramic, or combinations thereof. The materials or combination of materials used to form the variable volume member may be chosen based on one or more properties such as flexibility, puncture strength, tensile strength, and adaptability to certain processes such as blow molding, injection molding, and extrusion. In some embodiments, the material used to form all or portions of a variable volume member is flexible but rigid upon expansion, and of sufficient durability as to not be distorted by the flow of the one or more fiber mixtures.

In some embodiments, all or portions of a variable volume member includes a coating. The coating may be used to impart certain surface properties to the lamella. For example, in some embodiments, the coating may be smooth, and may have non-stick properties. Examples of materials that can be used for coatings include those materials listed herein for forming a lamella. In one set of embodiments, a coating comprises a fluorinated polymer such as polytetrafluoroethylene. Other materials can also be used.

In certain embodiments, all or portions (e.g., greater than 20%, greater than 50%, or greater than 70% by weight) of a lamella or a variable volume member are formed of a transparent material (e.g., Plexiglas or transparent polymers known to those of ordinary skill in the art) which can facilitate measurement of the degree of expansion and/or contraction of the variable volume member. Optionally, a lamella or a variable volume member may include gradations that can facilitate measurement of the degree of expansion and/or contraction of the variable volume member.

A variable volume member may be attached to a portion of a lamella using any suitable attachment technique. A variable member may be attached to non-variable volume portions of the lamella, or attached to other variable volume members. The variable volume member may removably attached or irreversibly attached to other portions of the lamella. The variable volume member may be attached to other portions of the lamella using, for example, adhesives, fasteners, metallic banding systems, railing mechanisms, or other support mechanisms. In another embodiment, the variable volume member is fabricated together with non-variable volume portions of the lamella (for example, by injection or blow molding).

A variety of control systems, including mechanisms, for controlling actuation (e.g., expansion or contraction) of a variable volume member can be implemented. In certain embodiments, a control system may include mechanical, electromechanical, hydraulic, or pneumatic systems to control actuation. All or portions of the control system/mechanism may extend outside of the flow zone in some embodiments, and may be either manually or automatically controlled. In some embodiments, a variable volume member may include one or more ports and/or valves for introducing and/or removing a substance from the variable volume member. The port and/or valve may have any suitable size and configuration, and may be made from any suitable material. The port and/or valve may be connected to a source (e.g., a fluid source) and/or a drain using tubing, channels, or other suitable conduits. In some cases, one or more pumps (e.g., injection pumps and/or vacuum pumps) may be used to introduce or remove a fluid from the variable volume member. Combinations of different mechanisms and/or control systems can also be used. Other mechanisms and configurations for controlling actuation of a variable volume member are also possible.

In some embodiments, a variable volume member is connected electronically to a control system for varying the volume of the variable volume member. Actuation (e.g., expansion or contraction) of a variable volume member may be controlled by the control system and may take place automatically by, for example, an automated control system, and/or may be controlled by input from a user. In some embodiments, instructions for actuating the variable volume member are pre-programmed into the control system, e.g., prior to initiating a production run. The one or more control systems can be implemented in numerous ways, such as with dedicated hardware and/or firmware, using a processor that is programmed using microcode or software to perform the functions described herein. In some embodiments, control of a variable volume member involves the use of sensors and/or negative or positive feedback (e.g., using a servomechanism). A control system can be used to actuate several variable volume members (e.g., simultaneously or alternately) in some embodiments. For example, in some embodiments, variable volume members may expand or contract simultaneously or alternately in the upper and lower portions of the flow zone. In other embodiments, variable volume members may expand or contract simultaneously or alternately in the same portion of a flow zone.

In some embodiments, a system for forming a fiber web includes one or more lamellas having and an adjustable angle within the flow zone. Changing the angle of a lamella can increase or decrease the relative pressures, and therefore the relative flow velocities, of the fiber mixtures flowing above and below the lamella. In some embodiments, the difference in relative pressures (or flow velocities) between two fiber mixtures can increase the level of turbulence (e.g., non-laminar flow) in the flow zone and/or in a fiber web forming zone. For instance, in some embodiments, a greater difference between the flow velocities of two adjacent fiber mixtures in the flow zone results in greater amounts of turbulence in the flow zone and/or the fiber web forming zone. As described herein, the increase in turbulence can result in the intermixing between fiber mixtures at a fiber web forming zone. This intermixing may cause the formation of one or more gradients across all or portions of the thickness of the resulting fiber web, as described herein.

Figure 7:
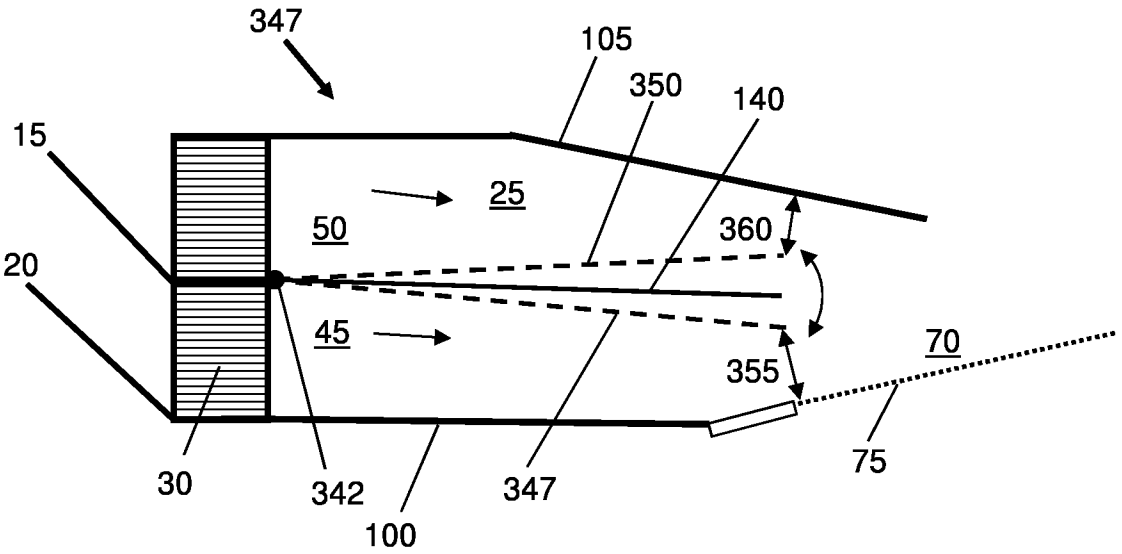
FIG. 7 is a schematic diagram showing a system for forming a fiber web including a lamella that can be positioned at different angles within the flow zone according to one set of embodiments.

An example of a system including a lamella having an adjustable angle is shown in the embodiment illustrated in FIG. 7. As shown illustratively in FIG. 7, a lamella 140 (e.g., a primary lamella), which separates flow zone 25 into lower portion 45 and upper portion 50, may include a pivoting member 342 attached thereto. The pivoting member may be pivotally attached at a fixed pivot point at an upstream end of the flow zone, and may allow the downstream end of the lamella to move up and down, thereby changing the angle of the lamella. The angle of the lamella may be measured relative to a line perpendicular to the major axis (e.g., height) of the distributor block. Changing the angle of the lamella can increase or decrease the relative pressures (and flow velocities) of the fiber mixtures in the upper and lower portions of the flow zone. For example, when lamella 140 is in a first position 347, the relative volume of the lower portion of the flow zone decreases (assuming the top and bottom surfaces are fixed). The height 355 between the lamella and the wire (or between the lamella and the bottom surface, depending on how far the lamella extends) also decreases. This position of the lamella results in an increased pressure (and flow velocity) of a fiber mixture flowing in the lower portion of the flow zone. The lamella in this position can also cause the relative volume of the upper portion of the flow zone to increase, thereby decreasing the pressure (and flow velocity) of a fiber mixture flowing in the upper portion.

Similarly, when lamella 140 is in a second position 350, the relative volume of the upper portion of the flow zone decreases (assuming the top and bottom surfaces are fixed). A height 360 between the lamella and the top surface also decreases. This position of the lamella results in an increased pressure (and flow velocity) of a fiber mixture flowing in the upper portion of the flow zone. The lamella in this position can also cause the relative volume of the lower portion of the flow zone to increase, thereby decreasing the pressure (and flow velocity) of a fiber mixture flowing in the lower portion. By increasing the difference in flow velocities between fiber mixtures in the lower and upper portions of the flow zone, the level of turbulence (e.g., non-laminar flow) may increase when the fiber mixtures meet at a fiber web forming zone. This turbulence can result in increased intermixing between the fiber mixtures at the fiber web forming zone.

Although FIG. 7 shows a pivoting member attached to an upstream end of the lamella (e.g., a primary lamella), it should be appreciated that other configurations are possible. For example, in some embodiments, a pivoting member may be positioned between an upstream end and a downstream end of the lamella such that the angle of a portion, but not all, of a lamella, is varied. In yet other embodiments, more than one pivoting members may be attached to a lamella. In yet other embodiments, a pivoting member may attached to a secondary lamella for varying the angle of the secondary lamella in the flow zone.

A lamella, or a portion of a lamella, may be adjusted to have any suitable angle within a flow zone. The angle of the lamella or a portion of the lamella as measured above or below a line perpendicular to the major axis of the distributor block, may be, for example, between 0° (perpendicular to the major axis of the distributor block) and 90° (parallel to the major axis of the distributor block). For example, the angle of the lamella may be between 0° and 10°, between 1° and 20°, between 20° and 45°, or between 45° and 90°. In some embodiments, a lamella or a portion of a lamella may be positioned at an angle of greater than or equal to 1°, greater than or equal to 2°, greater than or equal to 5°, greater than or equal to 10°, greater than or equal to 15°, greater than or equal to 20°, greater than or equal to 25°, greater than or equal to 30°, greater than or equal to 35°, greater than or equal to 40°, greater than or equal to 45°, greater than or equal to 50°, greater than or equal to 55°, greater than or equal to 60°, greater than or equal to 65°, greater than or equal to 70°, greater than or equal to 75°, greater than or equal to 80°, or greater than or equal to 85°, above or below a line perpendicular to the major axis of the distributor block. Other angles are also possible.

The pivoting member may be configured to be able to rotate at least 1°, at least 2°, at least 5°, at least 10°, at least 15°, at least 20°, at least 30°, at least 40°, at least 50°, at least 60°, at least 70°, at least 80°, at least 90°, at least 120°, at least 150°, or at least 180° in the flow zone. The angle of rotation of the pivoting member may depend on factors such as the length of the lamella, the height between the top and bottom surfaces of the flow zone, and the position of the lamella with respect to the height of the flow zone. For example, if the pivoting member of the lamella is positioned equidistant from the top and bottom surfaces (e.g., at the center of the distribution block), and the length of the lamella is less than half the height between the top and bottom surfaces, the pivoting member may be configured to rotate 90° above the center position, and 90° below the center position, for a total of 180°. Other angles are also possible.

In some instances in which the angle of the lamella or a portion of the lamella is adjusted from a first position to a second position, the differences between the first and second positions may be greater than or equal to 2°, greater than or equal to 5°, greater than or equal to 10°, greater than or equal to 15°, greater than or equal to 20°, greater than or equal to 25°, greater than or equal to 30°, greater than or equal to 35°, greater than or equal to 40°, or greater than or equal to 45°. Other differences are also possible.

In some embodiments, the angle of a lamella or a portion of the lamella within the flow zone is adjusted so that the distance between the downstream end of the lamella and a top surface, bottom surface, or wire is less than about less than about 1,800 mm, less than about 1,500 mm, less than about 1,000 mm, less than about 800 mm, less than about 600 mm, less than about 400 mm, less than about 200 mm, less than about 125 mm, less than about 100 mm, less than about 75 mm, less than about 50 mm, less than about 25 mm, or less than about 10 mm. In some instances, the angle of the lamella is adjusted so that the distance between the downstream end of the lamella and a top surface, bottom surface, or wire is less than about 80%, less than about 50%, less than about 30%, less than about 20%, less than about 15%, or less than about 2% of the distance when the lamella is positioned perpendicular to the major axis of the distributor block. The distance is typically measured normal to the top surface, bottom surface, or wire, as shown in FIG. 7 (e.g., distances 355 and 360). Other distances are also possible.

In some embodiments, a pivoting member may be actuated to rotate between two angles at a particular frequency. For example, the pivoting member may be rotated above and below the central position of the lamella at the angles described herein, e.g., between at least 1° above and 1° below the central position of the lamella, between at least 2°, at least 5°, at least 10°, at least 15°, at least 20°, at least 30°, at least 40°, at least 50°, at least 60°, at least 70°, at least 80°, or at least 90° above and below the central position of the lamella. Other angles are also possible. In some embodiments, the angle above the central position of the lamella is different from the angle below the central position of the lamella. The pivoting member may be actuated to rotate between two angles at a frequency of, for example, from about 10 cycles/min to about 600 cycles/min. For example, a pivoting member may be actuated at a frequency of greater than about 10 cycles/min, greater than about 60 cycles/min, greater than about 120 cycles/min, greater than about 360 cycles/min, or greater than about 600 cycles/min. Other frequencies are also possible. Such actuation may take place while one or more fiber mixtures is flowing in a flow zone.

As described herein, the flow velocity of a fiber mixture may vary in a portion of flow zone (e.g., in a lower or upper portion of the flow zone) and/or a fiber web forming zone. In certain embodiments, the angle of a lamella or a portion of the lamella within the flow zone is adjusted so that the flow velocity or pressure of a fiber mixture in a portion of a flow zone increases (or decreases) by at least 5%, at least 10%, at least 20%, at least 40%, at least 60%, or at least 80% relative to the flow velocity or pressure of the fiber mixture prior to adjustment.

A pivoting member may be attached to a portion of a system for forming a fiber web using any suitable attachment technique. In some embodiments, a pivoting member is attached directly to a distributor block. In other embodiments, a pivoting member is attached to a threaded rod positioned vertically within a portion of the flow zone. In yet other embodiments, a pivoting member is attached to two lamella portions. In certain embodiments, attachment involves the use of adhesives, fasteners, metallic banding systems, railing mechanisms, or other support mechanisms. Other attachment mechanisms are also possible.

A variety of control systems, including mechanisms, can be used to control the angle of a lamella in a flow zone. For example, in one embodiment a control system may include a pivoting member includes an adjustment wheel (e.g., gear wheel) that is connected to a lamella to allow control of the angle of the lamella within the flow zone. In certain embodiments, a pivoting member is connected to a motor (e.g., an electric motor) which can allow adjustments of the angle of the lamella. In certain embodiments, a control system may include mechanical, electromechanical, hydraulic, pneumatic or magnetic systems that can be used to control the angle. For example, in some embodiments, a pivoting member may comprise a rotating cam. In other embodiments, a servomechanism can be used. All or portions of the control system/mechanism may extend outside of the flow zone in some embodiments, and may be either manually or automatically controlled. Combinations of different mechanisms and/or control systems can also be used. Other mechanisms and configurations for controlling the angle of a lamella are also possible.

In some embodiments, a lamella includes a control system or mechanism for controlling angle that is electronically controlled. Adjustments of the angle of a lamella may be controlled by the control system and may take place automatically by, for example, an automated control system and/or may be controlled by input from a user. The one or more control systems can be implemented in numerous ways, such as with dedicated hardware and/or firmware, using a processor that is programmed using microcode or software to perform the functions described herein. In certain embodiments, instructions for adjusting the angle of a lamella or a portion thereof are pre-programmed into the control system, e.g., prior to initiating a production run. In some embodiments, control of the angle of one or more lamellas involves the use of sensors and/or positive or negative feedback (e.g., using a servomechanism). A control system can be used to adjust the angle of several lamellas (e.g., simultaneously or alternately) in some embodiments.

Where more than one lamellas are present, each of the angles of the lamellas may be controlled independently of one another. For instance, the angle of the lamellas may be controlled independently such that each of the angles of the lamellas can change depending on its location in the flow zone, the amount of fluid and/or pressure in the flow zone, the type of fiber mixture(s) in the flow zone, the amount of turbulence desired, and/or other conditions.

In some embodiments, a flow zone may be configured to receive a third fiber mixture, and the system may include a second lamella that separates the flow zone into three main portions. The second lamella may be positioned to divide the third fiber mixture from the first and/or second fiber mixtures in the flow zone. The first and/or second lamella may include a pivoting member attached thereto as described herein. Similarly, additional fiber mixtures (e.g., 4, 5, 6, etc., fiber mixtures) may be added with concurrent additional lamellas with optional pivoting members attached thereto as desired. Other configurations are also possible.

According to one set of embodiments, the angle of a lamella or a portion of a lamella may be varied while one or more fiber mixtures is flowing in the flow zone. The change in angle of a lamella or a portion thereof may vary the flow profile of one or more fiber mixtures flowing in the flow zone, and may affect the degree of mixing between fiber mixtures. For example, in some embodiments, laminar flow can be disrupted using such a process. Advantageously, in some embodiments, varying the angle of a lamella or a portion thereof can be used to form different fiber webs having different properties without ceasing fluid flow and/or without stopping a production run. A production run typically involves setting parameters of the system to form a fiber web having a particular set of properties. A first production run may involve, for example, forming a first fiber web having a particular set of properties using a lamella or a portion of a lamella in a first position (e.g., at a first angle). Then (e.g., without stopping the flow of the fiber mixtures), the position (e.g., angle) of the lamella or a portion thereof may be changed to a second position suitable for a second production run, i.e., forming a second fiber web having a particular set of properties different from the first fiber web. In some embodiments, these steps may be performed on a continuous basis, e.g., with an automated positioning device. Optionally, a different fiber mixture (e.g., a third fiber mixture) may be introduced into the flow zone before, during, or after changing the angle of one or more lamellas.

In other embodiments, adjusting the angle of one or more lamellas may be performed on a discontinuous basis, e.g., by shutting down the system, manually (or automatically) adjusting the angle of the lamella, and restarting the production run. In certain embodiments, the angle of one or more lamellas may be changed before or after a production run. For instance, a first production run may involve using a lamella in a first position involving a first angle within the flow zone. The first production run may be ceased (e.g., ceasing flow of the fiber mixtures), and then the angle of the lamella may be changed to a second position involving a second angle different from the first angle. A second production run can then be initiated while the lamella is in the second position.

As described herein, in some embodiments, the position and/or configuration of a lamella in the flow zone is adjustable, and optionally, a control system may be connected to the lamella for varying the position and/or configuration of the lamella in the flow zone. For example, a control system may be connected to a lamella and may be used to control the length of the lamella in the flow zone, as described in more detail below.

In some embodiments, a system for forming a fiber web includes one or more lamellas having an adjustable length. Changing the length of a lamella can increase or decrease the level of turbulence (e.g., non-laminar flow) within one or more fiber mixtures flowing in the flow zone. As described herein, the increase in turbulence in a portion of the flow zone can result in the intermixing between fiber mixtures at a fiber web forming zone. This intermixing may cause the formation of one or more gradients across all or portions of the thickness of the resulting fiber web. In some embodiments, a lamella having a relatively shorter length results in greater amounts of turbulence (and greater amounts of intermixing between fiber mixtures), while a lamella having a relatively longer length results in less amounts of turbulence (and less amounts of intermixing between fiber mixtures). The level of turbulence may also be affected by the position of the end of the lamella relative to where the dewatering system (e.g., vacuum boxes) begins.

A variety of control systems, including mechanisms, for controlling the length of a lamella in a flow zone can be implemented. For example, in one embodiment a control system may include an adjustment wheel which may be connected to a lamella to allow control of the length of the lamella within the flow zone. In another embodiment, a servomechanism can be used. In certain embodiments, a lamella may be connected to a motor (e.g., an electric motor) which can allow adjustments of the length of the lamella. In certain embodiments, a control system may include mechanical, electromechanical, hydraulic, pneumatic or magnetic systems that can be used to control length. All or portions of the control mechanism may extend outside of the flow zone in some embodiments, and may be either manually or automatically controlled. Combinations of different mechanisms and/or control systems can also be used. Other mechanisms and configurations for controlling length of a lamella are also possible.

Figure 8:
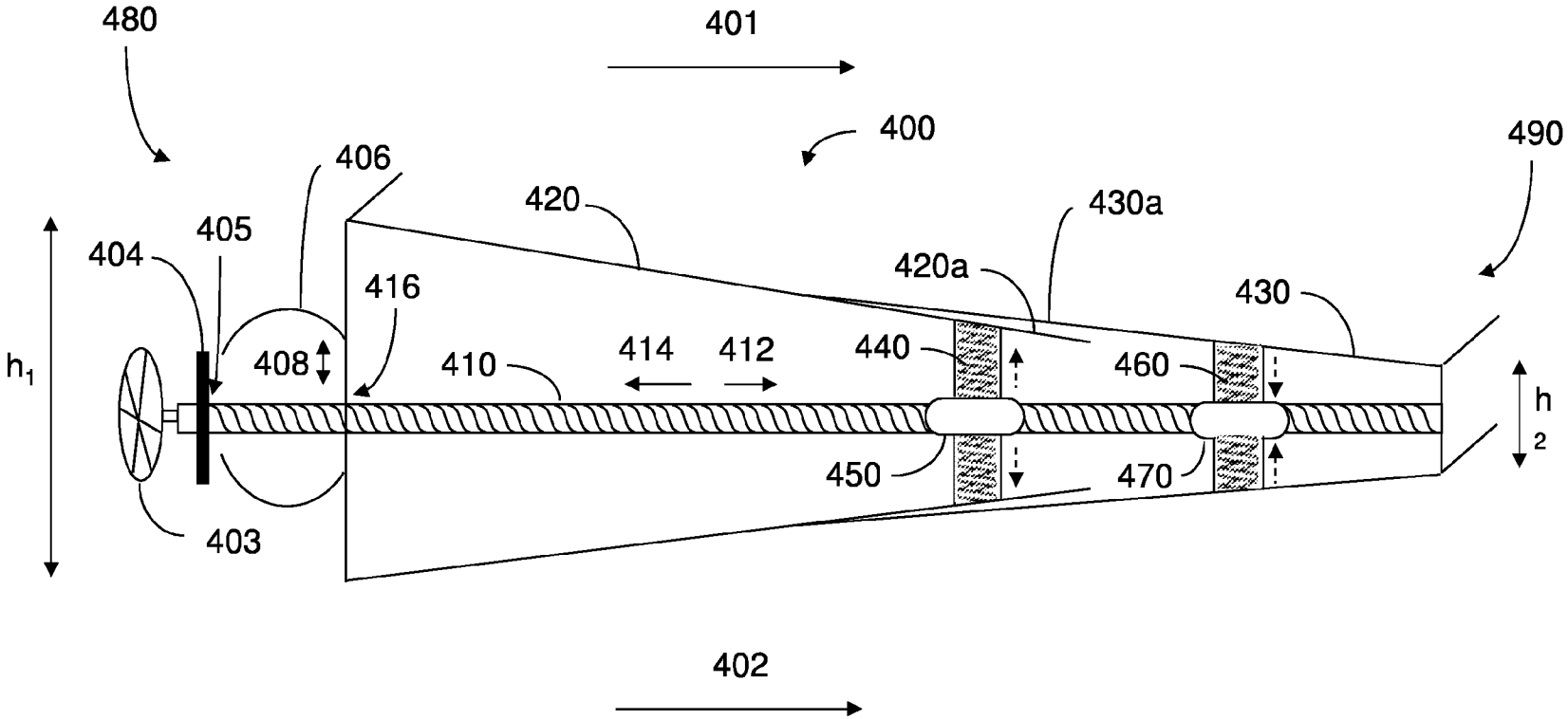
FIG. 8 is a schematic diagram showing a lamella having an adjustable length according to one set of embodiments.

An example of a lamella having an adjustable length is shown in the embodiment illustrated in FIG. 8. FIG. 8 depicts a schematic of an exemplary embodiment showing an inner side view profile of a lamella 400 (e.g., a primary lamella or a secondary lamella) that is adjustable in length. As described herein, fiber mixtures may flow above and/or below lamella 400 along directions 401, 402 from an upstream end 480 to a downstream end 490 of the lamella and into a fiber web forming zone. Lamella 400 may include an adjustment member 410 that can be extended or retracted back and forth as desired along a suitable direction 412, 414 axial to the adjustment member. In some embodiments, and without limitation, adjustment member may include a threaded rod that may be appropriately engaged with a structural member of the lamella permitting the adjustment member, upon suitable rotation, to move within the lamella in accordance with the threaded pattern. For example, as the adjustment member is appropriately rotated (e.g., clockwise or counter-clockwise) with respect to a suitable structural member of the lamella, the threaded portion may enable the adjustment member to be displaced along one of directions 412, 414. The adjustment member may include any appropriate structure other than a threaded rod to enable the lamella 400 to be suitably lengthened or shortened. For example, in some embodiments not shown, the adjustment member may include a sliding bar that optionally includes notched locking regions. Alternatively, the adjustment member may include a telescoping structure that permits the adjustment member to be extended or retracted at discrete points along the lamella. Other configurations are also possible.

In some embodiments, the lamella may include a first plate structure 420 and an end plate structure 430 within which a substantial portion of the adjustment member 410 may be disposed. As shown, plate structures may include upper, lower and/or side plate portions that surround an appropriate space. The first plate structure may include an opening 416 (e.g., at a side plate portion) through which the adjustment member may pass. Accordingly, a portion of the adjustment member that is disposed at a downstream side of the opening may be located interior to the first plate structure and the end plate structure; and another portion of the adjustment member disposed at an upstream side of the opening may be located exterior to the first plate structure and the end plate structure.

In some embodiments, the opening of the first plate structure may include a threaded structure so as to suitably accommodate a threaded portion of the adjustment member. In certain embodiments, the adjustment member may be attached at downstream end 490 of the lamella to the end plate structure such that the end plate structure moves along with the adjustment member in concert and relative to the first plate structure when the adjustment member translates along directions 412, 414. Thus, in one such embodiment, when the adjustment member moves along direction 412, the end plate structure moves away from the first plate structure in a manner that increases the overall length of the lamella 400; and when the adjustment member moves along direction 414, the end plate structure moves toward the first plate structure resulting in a decrease of the overall length of the lamella 400. First plate structure 420 may or may not be fixed along directions 412, 414 relative to the adjustment member and end plate structure 430.

In certain embodiments, the height $h_1$ of upstream end 480 of the lamella (e.g., side plate portion of the first plate structure) is greater than the height $h_2$ of downstream end 490 of the lamella (e.g., side plate portion of the end plate structure). In some cases, when the height $h_1$ of the lamella at upstream end 480 is greater than the height $h_2$ of the lamella at downstream end 490, fiber mixtures may flow above and/or below the lamella from the upstream end toward the downstream end of the lamella in a manner that results in flow that is more laminar in nature at the fiber web forming zone. However, in other embodiments, the height $h_1$ of the lamella at the upstream end 480 may be substantially the same or less than the height $h_2$ of the lamella at the downstream end 490. In some cases, when height $h_2$ is greater than height $h_1$, flow of fiber mixtures at the fiber web forming zone may be less laminar in nature (e.g., more turbulent) as compared to when height $h_2$ is less than height $h_1$.

The heights $h_1$, $h_2$ at opposing end regions of the lamella may be any suitable distance. In some embodiments, the height $h_1$ of the lamella at upstream end 480 may be between about 1/16" and about 1", between about 1/8" and about 7/8", between about 1/4" and about 3/4", or between about 3/8" and about 5/8", or be about 1/2". In some embodiments, the height $h_2$ of the lamella at downstream end 490 may be between about 1/32" and about 1", between about 1/16" and about 1/2", between about 1/16" and about 1/4", or be about 1/8". The lamella may include any suitable ratio of heights $h_1$, $h_2$. In some embodiments, the ratio of height $h_1$ to height $h_2$ may be between about 0.1 and about 10, between about 0.5 and about 8, between about 0.25 and about 6, or between about 1 and about 5. Height $h_1$ may be greater (or less than) height $h_2$ by any suitable percentage of $h_2$. In some embodiments, the height of $h_1$ is greater than (or less than) $h_2$ by about 10% of $h_2$, by about 20% of $h_2$, by about 50% of $h_2$, by about 100% of $h_2$, by about 200% of $h_2$, by about 400% of $h_2$, by about 600% of $h_2$, by about 800% of $h_2$, or by about 1,000% of $h_2$, Other differences in heights are also possible.

Figure 9:
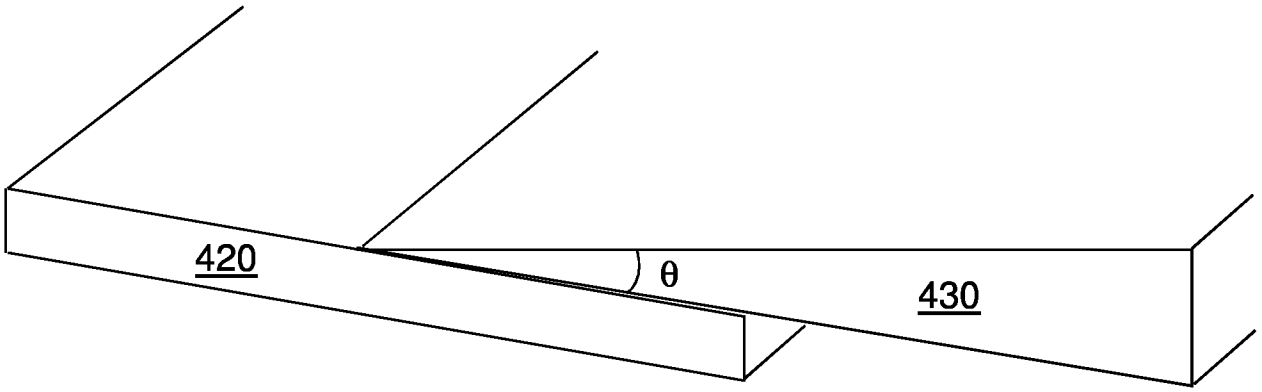
FIG. 9 is a schematic diagram showing overlapping plates of a lamella having an adjustable length according to one set of embodiments.

As illustratively shown in FIG. 8, first plate structure 420 and end plate structure 430 may overlap such that the first plate structure may have a portion 420*a* facing the interior of the lamella, and the end plate structure may have a portion 430*a* exterior with respect to the first plate structure. First plate structure 420 and end plate structure 430 may also overlap in a manner that minimizes space between surfaces of the plates. FIG. 9 illustrates an exemplary embodiment where a portion of end plate structure 430 overlaps with and has a shape that complements the orientation of a portion of first plate structure 420. In certain embodiments, the end plate structure may optionally include a portion having a wedge-like shape where two edges of form an angle θ. For example, the angle 0 may be less than about 15 degrees, less than about 10 degrees, less than about 5 degrees, or less than about 3 degrees. In other embodiments, angle 0 may be greater than about 3 degrees, greater than about 5 degrees, or greater than about 10 degrees. Other angles may also be possible. In various embodiments, angle θ may depend on the dimensions and orientation of the first plate structure. In other embodiments, portions of the first plate structure may optionally include a shape that has two edges that form a suitable angle.

In some embodiments, an overlapping plate configuration may minimize or, in some cases, prevent irregular surfaces (e.g., sharp edges or ridges) from arising on the lamella plate(s) as the length of the lamella is adjusted. In some cases, irregular surfaces, particularly sharp surfaces, may give rise to catching or bundling of fibers as a fiber mixture flows across the surface, increasing the possibility for fibers to undesirably clump together on the surface. By facilitating smooth flow of a fiber mixture across the surface of the lamella plate(s), it may be possible for fiber webs to be more consistently formed. However, in some embodiments, certain irregular surfaces on the lamella may be desirable.

Referring back to FIG. 8, at upstream end 480 of the lamella, adjustment member 410 may be attached to a manipulating member 403 which can be used by an operator and/or automated system to appropriately actuate and cause displacement of the adjustment member. As an illustrative example, the manipulating member may include a rotatable adjustment wheel which allows for the adjustment member to be suitably rotated. Other manipulating elements besides an adjustment wheel are possible. For example, the manipulating member may include a lever and/or a handle that an operator and/or automated system may engage (e.g., push or pull) to move the adjustment member back and forth along directions 412, 414. Alternatively, a manipulating member may include a button that may be pushed to activate an automated system for adjusting the length of the lamella.

To provide added structural support, lamella 400 may optionally include a backing structure 404 and a mount member 406. The backing structure (e.g., a backing plate) may be a fixed structure that includes an opening 405 through which the adjustment member may pass. In some embodiments, the opening of the backing structure may include a threaded structure for suitably engaging a threaded rod of the adjustment member upon rotation of the threaded rod. In certain embodiments, the mount member (e.g., a plate mount to the distributor block) may also provide structural support. The mount member may be attached to the first plate structure in a manner that enables vertical float of the mount member with respect to the adjustment member. Accordingly, while the mount member remains generally fixed with respect to directions 412, 414, the mount member may move vertically as indicated by direction arrows 408. Such an ability to vertically float may allow for the lamella to exhibit a suitable amount of flexibility when subject to fiber mixture flow forces. In some embodiments, the mount member may be constructed to have a convex shape which, in some cases, may also provide for added flexibility and strength tolerance of the lamella during fiber mixture flow. In various embodiments, the distributor block may include a shape (e.g., concave) that is complementary to that of the mount member for suitably receiving the mount member.

Further, in certain embodiments, the lamella may include biasing members 440, 460 each corresponding and attached to first plate structure 420 and end plate structure 430. Biasing members, as described herein, may be any suitable member that provides a compressive or tensile biasing force to another member, for example, a spring. Biasing member 440 may exert a compression-type force (illustrated by corresponding dashed arrows) that pushes outward on an inner surface of the first plate structure, resulting in a biasing force from the first plate structure against the inner surface of the end plate structure. In contrast, biasing member 460 may exert a tension-type force (illustrated by corresponding dashed arrows) that pulls the end plate structure inward, resulting in a biasing force of an inner surface of the end plate structure toward the outer surface of the first plate structure. Due to forces provided by biasing members 440, 460, a generally tight connection may arise between the first plate structure and the end plate structure. In some embodiments, the tight connection between the first plate structure and the end plate structure is air tight or water tight.

Additionally, biasing member attachment regions 450, 470 may be provided in a manner that allows for biasing members 440, 460 to be structurally supported while not interfering with movement of the adjustment member 410. In some embodiments, biasing member attachment regions 450, 470 may have openings through which adjustment member is permitted to pass through. The openings of biasing member attachment regions 450, 470 may or may not have a threaded structure. Biasing member attachment regions 450, 470 may also provide anchor locations for biasing members 440, 460 to engage with respective first plate structure 420 and end plate structure 430.

Although FIG. 8 shows a side view of an exemplary embodiment of a lamella 400 depicting only one adjustment member 410, in various embodiments described herein, the lamella may include more than one adjustment member (e.g., 2, 3, 4, 5, 6, 7, 8, 9, or more adjustment members). For example, a lamella that can be adjustable in length may include a plurality of adjustment members disposed adjacent to one another and in spaced apart relation (e.g., across the width of the lamella). Adjustment members may be spaced any suitable distance apart from one another. In some embodiments, adjustment members are spaced apart at a distance of between about 1 inch and about 36 inches, between about 2 inches and about 30 inches, between about 6 inches and about 24 inches, between about 8 inches and about 16 inches, between about 10 inches and about 14 inches, or about 12 inches. The distance between which adjustment members are spaced may also differ within a lamella. For example, adjustment members may or may not be regularly spaced apart from one another.

In addition to one or more adjustment members, as described herein, the lamella may include any suitable number of manipulating members, backing structures, mount members, biasing members, biasing member attachment regions, and/or plates (described further below). For example, a plurality of adjustment members may be manipulated by a single manipulating member or, alternatively, each adjustment member may be structurally engaged with its own manipulating member. Similarly, one or more appropriately constructed backing structures and/or mount members may be provided for any number of adjustment members. In some embodiments, biasing members and/or biasing member attachment regions may extend across multiple adjustment members or, in some cases, may be confined to individual adjustment members.

Figure 10:
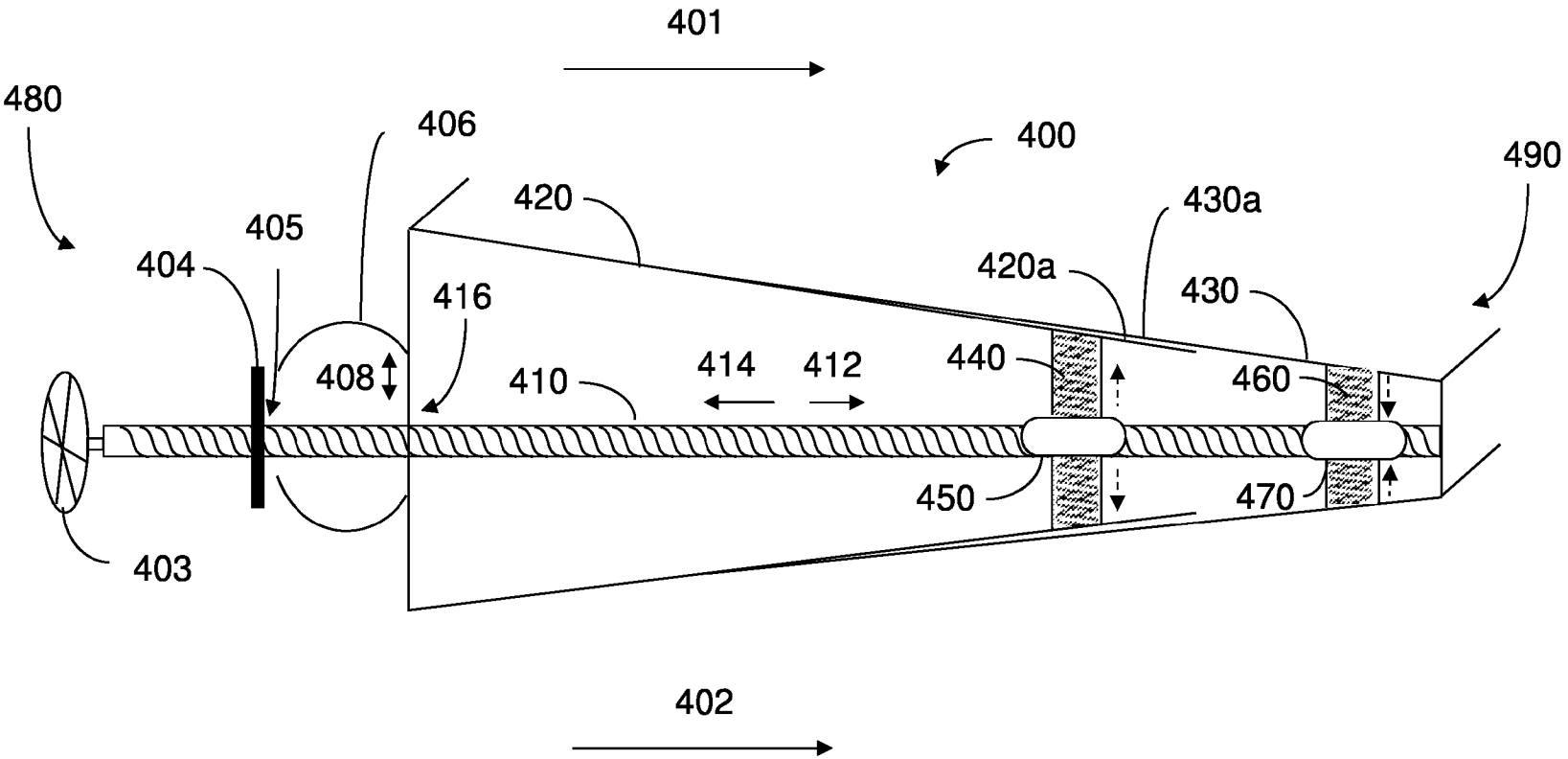
FIGS. 10-12 are schematic diagrams showing various configurations of lamellas having an adjustable length according to one set of embodiments.

In operation according to the embodiments illustrated by FIGS. 8 and 10, the adjustment member 410 may be displaced in a direction 412 that lengthens the lamella 400, or the adjustment member may be displaced in a direction 414 that shortens the lamella. In certain embodiments, as illustratively shown in FIG. 8, and without limitation, the manipulating member 403 and the end plate structure 430 may move together with the adjustment member; whereas the backing structure 404, mounting member 406 and first plate structure 420 may be fixed without moving relative to the adjustment member along either of directions 412, 414.

In some embodiments, portions of an adjustment member may be moved in and out of the first plate structure. In some embodiments, when the adjustment wheel of the manipulating member is turned in a suitable direction (e.g., clockwise), the threaded portion of the adjustment member rotates in a manner that moves the adjustment member in a direction 412 further into the first plate structure, pushing the end plate structure further away from the first plate structure. As the end plate structure moves away from the first plate structure, the lamella is lengthened. FIG. 8 shows a lamella in a generally extended configuration where a substantial portion of the adjustment member is disposed within the first plate structure. Though, when the adjustment wheel is rotated in an opposite direction (e.g., counter-clockwise), the threaded portion of the adjustment member may cause the adjustment member to move in a direction 414 such that a portion of the adjustment member moves outside of the first plate structure, bringing the end plate structure toward the first plate structure. As the end plate structure moves toward the first plate structure, the lamella is shortened. FIG. 10 illustrates a lamella in a more retracted configuration where a greater portion of the adjustment member is disposed outside of the first plate structure at the upstream end. In contrast, FIG. 8 depicts more of the adjustment member to be disposed within the first plate structure as compared to FIG. 10.

Figure 11:
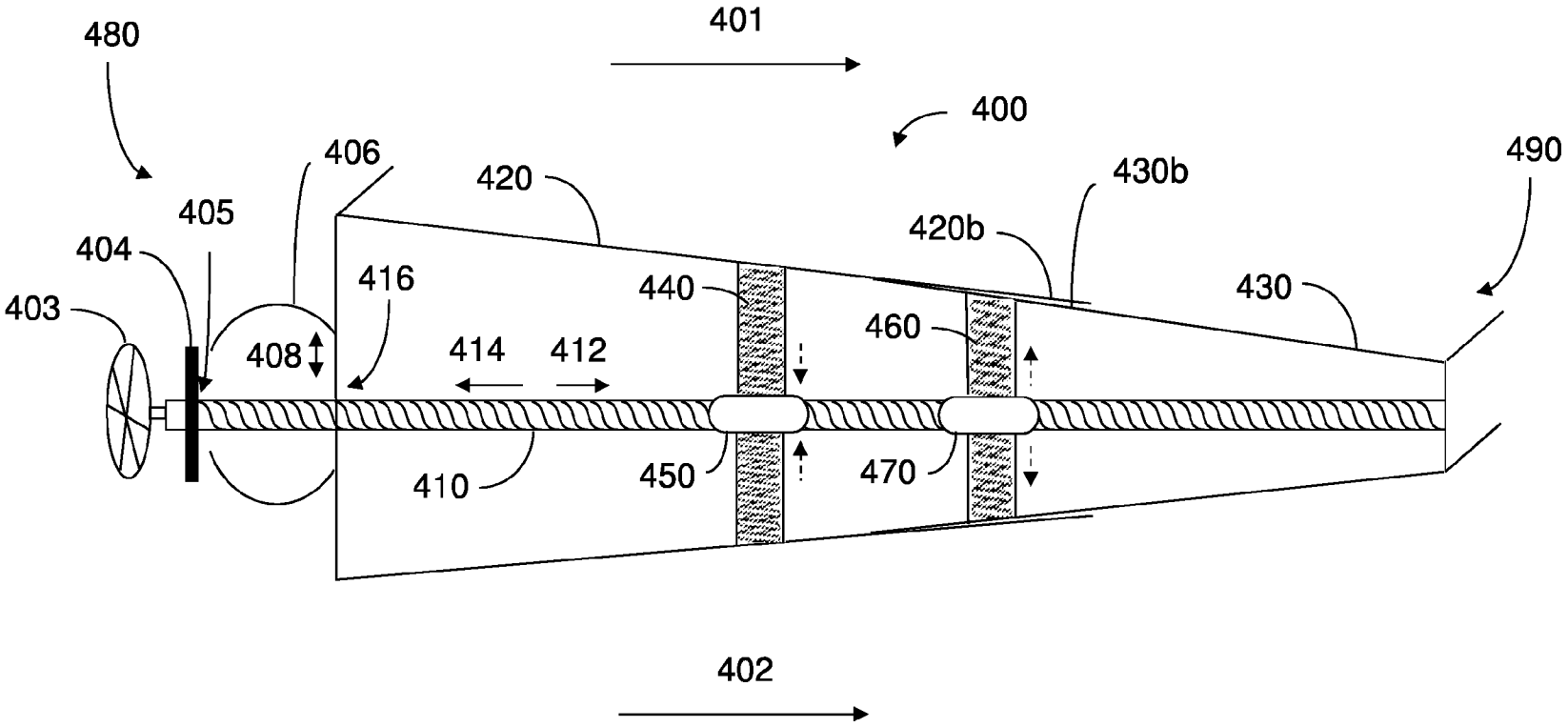

In certain embodiments, first plate structure 420 and end plate structure 430 may be constructed in a configuration that is inverted with respect to the embodiment of FIG. 8. FIG. 11 illustrates an exemplary embodiment that includes overlapping plates such that a portion 420*b* of first plate structure 420 surrounds a portion 430*b* of end plate structure 430. Accordingly, for the embodiment of FIG. 11, biasing member 440 exerts a tension-type force (illustrated by corresponding dashed arrows) pulling on an inner surface of the first plate structure, resulting in a biasing force from the first plate structure 420 against an outer surface of the end plate structure 430. Biasing member 460 exerts a compression-type force (illustrated by corresponding dashed arrows) that pushes outward against an inner surface of the end plate structure, resulting in a biasing force of the end plate structure 430 toward an inner surface of the first plate structure 420. Similar to that described above with respect to the configuration in FIG. 8, in various embodiments, a generally tight connection may arise, minimizing space between the first plate structure and the end plate structure.

Figure 12:
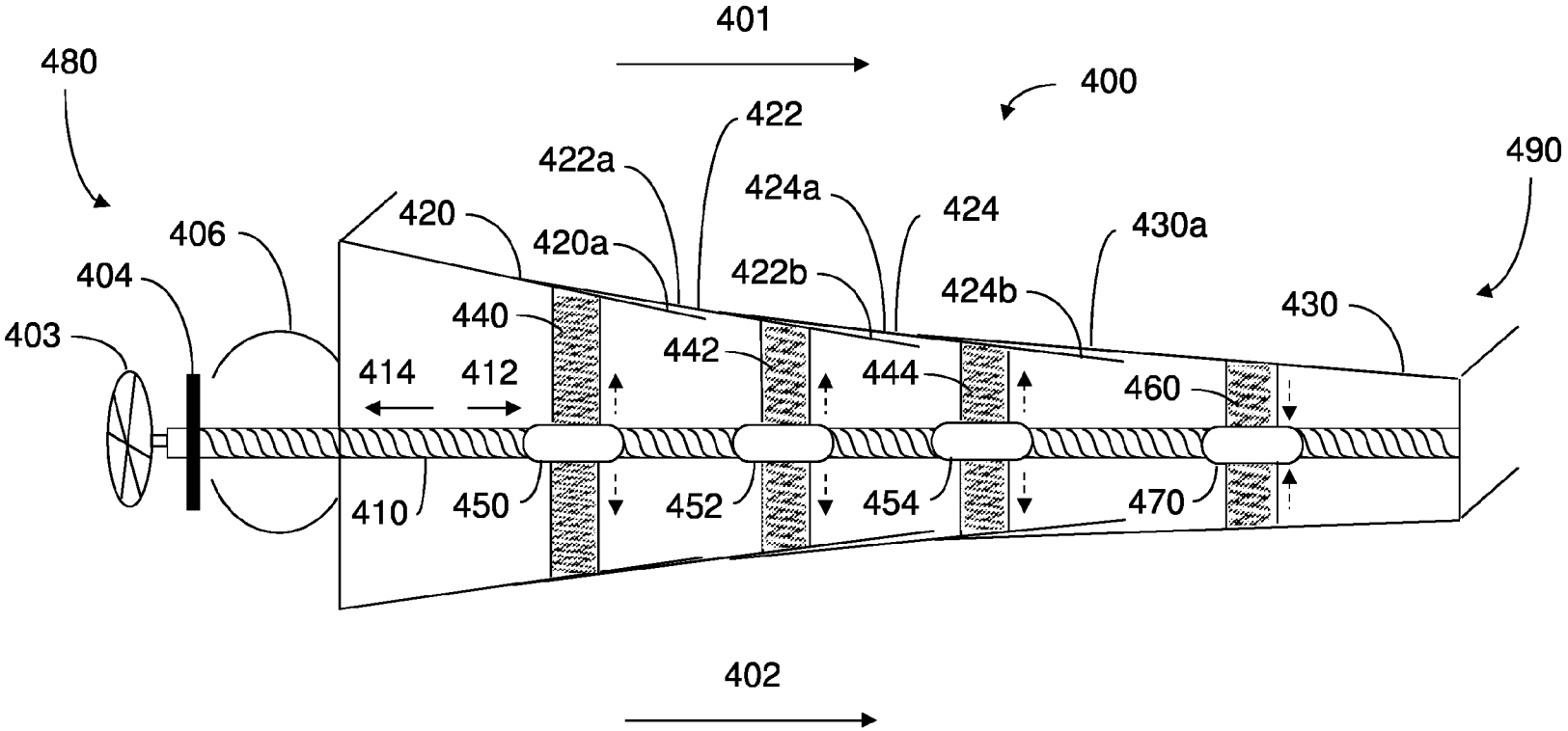

In other embodiments, a lamella may include a multiple plate configuration. For example, FIG. 12 illustrates an exemplary embodiment of a lamella 400 having a first plate structure 420, intermediate plate structures 422, 424 and an end plate structure 430. In this embodiment, first plate structure 420 includes a portion 420*a* that may be surrounded by a portion 422*a* of intermediate plate structure 422. A portion 422*b* of intermediate plate structure 422 may be surrounded by a portion 424*a* of intermediate plate structure 424. A portion 424*b* of intermediate plate structure 442 may be surrounded by a portion 430*a* of end plate structure 430. Other configurations are also possible.

As shown illustratively in FIG. 12, first plate structure 420 and intermediate plate structures 422, 424 may include respective biasing members 440, 442, 444 that exert compression-type forces (illustrated by corresponding dashed arrows) outward on a region of a respective neighboring outer plate. For example, biasing member 440 may provide an outward biasing force that causes first plate structure to push out on an inner surface of intermediate plate structure 422. In turn, biasing member 442 may exert a biasing force on intermediate plate structure 422 resulting in plate 422 pushing outwardly on an inner surface of intermediate plate structure 424. Further, biasing member 444 may provide an outward force on intermediate plate structure 424 so that plate 424 pushes outward on an inner surface of end plate structure 430. Additionally, in accordance with certain embodiments described herein, biasing member 460 may exert a tension-type force (illustrated by corresponding dashed arrows)

inward on a region of a neighboring inner plate. For example, biasing member 460 may provide an inward biasing force that causes end plate structure 430 to exert an inward force toward an outer surface of intermediate plate structure 424. Although not being so limited, forces exerted by biasing members may result in a generally tight connection (e.g., air tight, water tight) between each neighboring plate. It can be appreciated that any suitable configuration of biasing members and plates may be used.

Continuing to refer to FIG. 12, biasing members 440, 442, 444, 460 may be attached to biasing member attachment regions 450, 452, 454, 470 which may have openings through which the adjustment member 410 may pass. In accordance with that described herein, openings of biasing member attachment regions 450, 452, 454, 470 may or may not include a threaded structure. Accordingly, biasing members may be suitably anchored while also not interfering with movement of the adjustment member.

It can be appreciated that an adjustable length lamella may incorporate any appropriate structure that provides for the ability to lengthen or shorten the lamella in a manual and/or automatic manner. In certain embodiments, the length of the lamella can be adjusted during operation of the overall system. That is, the lamella may be appropriately adjusted without having to stop the flow of fiber mixtures in the system or having to remove/replace any portions of the lamella. In some embodiments, for systems where the lamella may be manually adjusted, adjustment wheels, servo-mechanisms, and/or other manipulating members may be disposed outside of the flow zone to allow an operator to control the length of the lamella, for example, to achieve a desired level of mixing between the different fiber mixtures. Accordingly, the lamella may be adjusted to control mixing of different fiber mixtures, giving rise to a gradient (e.g., abrupt or more gradual) across a thickness of the fiber web as described herein. In some embodiments, a feedback loop (e.g., negative or positive feedback) may be employed, where certain properties of the fiber mixtures are measured and the length of the lamella is appropriately adjusted in accordance with the level of mixing desired. Such a feedback loop may be automatic and/or manual in nature.

In some embodiments, a lamella includes a mechanism for controlling length that is electronically connected to a control system. Adjustments of the length of a lamella may be controlled by the control system and may take place automatically by, for example, an automated control system and/or may be controlled by input from a user. In some embodiments, instructions for adjusting the length of a lamella are pre-programmed into the control system, e.g., prior to initiating a production run. The one or more control systems can be implemented in numerous ways, such as with dedicated hardware and/or firmware, using a processor that is programmed using microcode or software to perform the functions described herein. In some embodiments, control of the length of one or more lamellas involves the use of sensors and/or negative or positive feedback (e.g., using a servo-mechanism). A control system can be used to adjust the length of several variable length lamellas (e.g., simultaneously or alternately) in some embodiments.

Where more than one lamellas are present, each of the lengths of the lamellas may be controlled independently of one another. For instance, the length of the lamellas may be controlled independently such that each of the lengths of the lamellas can change depending on its location in the flow zone, the amount of fluid and/or pressure in the flow zone, the type of fiber mixture(s) in the flow zone, the amount of turbulence desired, and/or other conditions.

According to one set of embodiments, the length of a lamella may be varied while one or more fiber mixtures is flowing in the flow zone. The change in length of a lamella may change the flow profile of one or more fiber mixtures flowing in the flow zone, and may affect the degree of mixing between fiber mixtures. Advantageously, in some embodiments, such a process can be used to form different fiber webs having different properties without ceasing fluid flow and/or without stopping a production run. A production run typically involves setting parameters of the system to form a fiber web having a particular set of properties. A first production run may involve, for example, forming a first fiber web having a particular set of properties using a lamella in a first position (e.g., having a first length). Then (e.g., without stopping flow of the fiber mixtures), the position (e.g., length) of the lamella may be changed to a second position suitable for forming a second fiber web having a particular set of properties different from the first fiber web. This may either be done on a continuous basis with an automated control/positioning device or on a discontinuous basis by shutting down, manually adjusting the lamella length(s), and restarting the production run. Optionally, a different fiber mixture (e.g., a third fiber mixture) may be introduced into the flow zone before, during, or after changing the length of one or more lamellas.

In other embodiments, adjusting the length of a lamella may be performed on a discontinuous basis, e.g., by shutting down the system, manually (or automatically) adjusting the length of the lamella(s), and restarting the production run. In certain embodiments, the length of one or more lamellas may be changed before or after a production run. For instance, a first production run may involve using a lamella in a first position involving a first length within the flow zone. The first production run may be ceased (e.g., ceasing flow of the fiber mixtures), and then the length of the lamella may be changed to a second position involving a second length different from the first length. A second production run can then be initiated while the lamella is in the second position. In certain embodiments, the length of a lamella can change (e.g., increase or decrease) by at least 20%, at least 40%, at least 60%, or at least 80% from a first position to a second position during a production run, or between production runs.

In yet other embodiments, a flow zone may be configured to receive a third fiber mixture, and the system may include a second lamella that separates the flow zone into three main portions. The second lamella may be positioned to divide the third fiber mixture from the first and/or second fiber mixtures in the flow zone. Optionally, one or more adjustable length lamellas may be positioned in one or more of the three portions of the flow zone to disrupt laminar flow. Similarly, additional fiber mixtures (e.g., 4, 5, 6, etc., fiber mixtures) may be added with concurrent additional lamellas as desired. Other configurations are also possible.

Any suitable fiber mixture may be introduced into a system for forming a fiber web. A fiber mixture generally contains a mixture of at least one or more fibers and a solvent such as water. Examples of fibers include glass fibers, synthetic fibers, cellulose fibers, and binder fibers. The fibers may have various dimensions such as fiber diameters between about 0.1 microns and about 50 microns. The mixture may optionally contain one or more additives such as pH adjusting materials, viscosity modifiers, and surfactants.

The terms "first fiber mixture" and "second fiber mixture" as used herein generally refer to fiber mixtures flowing in different portions of a flow zone. It should be appreciated that while a first fiber mixture and a second fiber mixture may be different, in other embodiments the fiber mixtures may be the same. For example, in one set of embodiments, a first fiber mixture has the same composition as a second fiber mixture (e.g., a first fiber mixture may have the same types of components and the same concentration of components as those of a second fiber mixture). In other embodiments, a first fiber mixture has a different composition from that of a second fiber mixture (e.g., a first fiber mixture may have at least one different type of component and/or a different concentration of at least one component from that of a second fiber mixture). Types of components that may differ between fiber mixtures may include, for example, fiber type, fiber diameter, and additive type.

In one particular set of embodiments, a "first fiber" contained in the first fiber mixture may be the same as a "second fiber" contained in the second fiber mixture. In other embodiments, a "first fiber" contained in the first fiber mixture may be different from a "second fiber" contained in the second fiber mixture. First and second fiber mixtures may also differ in the presence and/or absence of one or more components relative to the other. Combinations of such differences and other configurations of first and second fiber mixtures are also possible. It can be appreciated that the description above with respect to first and second fiber mixtures also applies to additional fiber mixtures (e.g., a "third fiber mixture", a "fourth fiber mixture", etc.). In some cases, a fiber mixture is processed prior to introduction into the flow zone of the system. For example, a fiber mixture may be prepared in one or more pulpers. After appropriately mixing the fiber mixture in a pulper, the mixture may be pumped into a flow distributor such as a headbox, where the fiber mixture may optionally be combined with other fiber mixtures or additives. The fiber mixture may also be diluted with additional water such that the final concentration of fiber is in a suitable range, such as for example, between about 0.01% to about 2% by weight (e.g., between about 0.1% to about 1% by weight, or between about 0.1% to about 0.5% by weight). Other concentrations are also possible.

Optionally, before the fiber mixture is sent to a flow distributor, the fiber mixture may be passed though centrifugal cleaners for removing contaminants or unwanted materials (e.g., unfiberized material used to form the fibers). The fiber mixture may be optionally passed through additional equipment such as a refiner or a deflaker to further enhance the dispersion of the fibers prior to their introduction into the flow zone. A fiber mixture may contain any suitable component for forming a fiber web. In some embodiments, a fiber mixture includes one or more glass fibers. The glass fibers may be, for example, microglass fibers or chopped strand glass fibers, which are known to those of ordinary skill in the art. The microglass fibers may have relatively small diameters such as less than about 10.0 microns (e.g., between about 0.1 microns and about 10.0 microns). Fine microglass fibers (e.g., fibers less than 1 micron in diameter) and/or coarse microglass fibers (e.g., fibers greater than or equal to 1 micron in diameter) may be used. The aspect ratios (length to diameter ratio) of the microglass fibers may be generally in the range of about 100 to 10,000. Chopped strand glass fibers may have diameters of, for example, between about 5 microns and about 30 microns, and lengths in the range of between about 0.125 inches and about 1 inch. Other dimensions of glass fibers are also possible.

In some embodiments, a fiber mixture includes one or more synthetic fibers. Synthetic fibers may be, for example, binder fibers, bicomponent fibers (e.g., bicomponent binder fibers) and/or staple fibers. In general, the synthetic fibers may have any suitable composition. Non-limiting examples of synthetic fibers include PVA (polyvinyl alcohol), aramides, polytetrafluoroethylenes, polyesters, polyethylenes, polypropylenes, acrylic resins, polyolefins, polyamides, polystyrene, nylon, rayon, polyurethanes, cellulosic or regenerated cellulosic resins, copolymers of the above materials, and combinations thereof. It should be appreciated that other suitable synthetic fibers may also be used. Synthetic fibers may have fiber diameters ranging from, for example, between about 5 microns and about 50 microns. Other dimensions of synthetic fibers are also possible.

In one set of embodiments, a fiber mixture includes one or more binder fibers (e.g., PVA binder fibers). Binder fibers may have fiber diameters ranging from, for example, between about 5 microns and about 50 microns. Other dimensions of binder fibers are also possible.

In one set of embodiments, a fiber mixture includes one or more bicomponent fibers. The bicomponent fibers may comprise a thermoplastic polymer. Each component of the bicomponent fiber can have a different melting temperature. For example, the fibers can include a core and a sheath where the activation temperature of the sheath is lower than the melting temperature of the core. This allows the sheath to melt prior to the core, such that the sheath binds to other fibers in the layer, while the core maintains its structural integrity. The core/sheath binder fibers can be concentric or non-concentric. Other exemplary bicomponent fibers can include split fiber fibers, side-by-side fibers, and/or "island in the sea" fibers. Bicomponent fibers may have fiber diameters ranging from, for example, between about 5 microns and about 50 microns. Other dimensions of bicomponent fibers are also possible.

In another set of embodiments, a fiber mixture includes one or more cellulose fibers (e.g., wood pulp fibers). Suitable cellulose fiber compositions include softwood fibers, hardwood fibers and combinations thereof. Examples of softwood cellulose fibers include fibers that are derived from the wood of pine, cedar, alpine fir, douglas fir, and spruce trees. Examples of hardwood cellulose fibers include fibers derived from the wood of eucalyptus (e.g., Grandis), maple, birch, and other deciduous trees. Cellulose fibers may have fiber diameters ranging from, for example, between about 5 microns and about 50 microns. Other dimensions of cellulose fibers are also possible.

Figure 13:
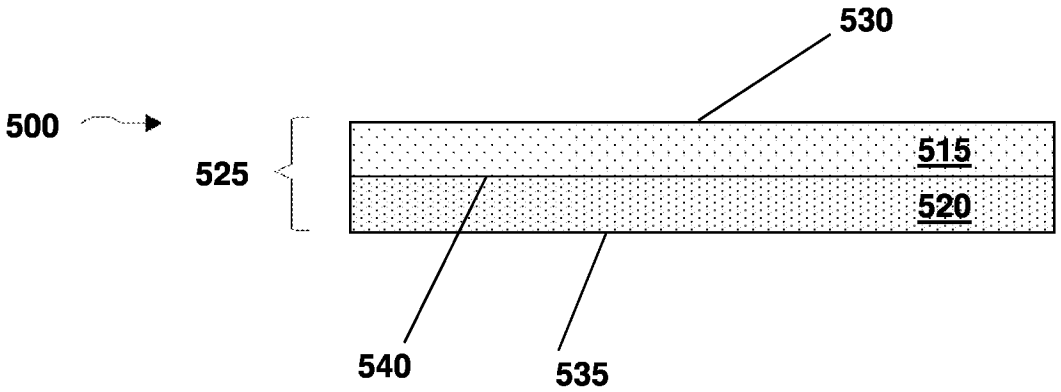
FIG. 13 is a schematic diagram showing a fiber web according to one set of embodiments.

The methods and systems described herein can be used to form fiber webs having a single layer, or multiple layers. In some embodiments involving multiple layers, a clear demarcation of layers may not always be apparent. An example of a fiber web that can be formed using the methods and systems described herein is shown in FIG. 13. As shown illustratively in FIG. 13, a fiber web 500 includes a first layer 515 and a second layer 520. The first layer may be formed from a first fiber mixture and the second layer may be formed from a second fiber mixture, as described herein. Optionally, the fiber web may include additional layers (not shown). Fiber web 500 may be non-woven.

In some embodiments, fiber web 500 includes a gradient (i.e., a change) in one or more properties such as fiber diameter, fiber type, fiber composition, fiber length, fiber surface chemistry, pore size, material density, basis weight, solidity, a proportion of a component (e.g., a binder, resin, crosslinker), stiffness, tensile strength, wicking ability, hydrophilicity/hydrophobicity, and conductivity across a portion, or all of, a thickness 525 of the fiber web. Fiber webs suitable for use as filter media may optionally include a gradient in one or more performance characteristics such as efficiency, dust holding capacity, pressure drop, air permeability, and porosity across the thickness of the fiber web. A gradient in one or more such properties may be present in the fiber web between a top surface 530 and a bottom surface 535 of the fiber web.

Different types and configurations of gradients are possible within a fiber web. In some embodiments, a gradient in one or more properties is gradual (e.g., linear, curvilinear) between a top surface and a bottom surface of the fiber web. For example, the fiber web may have an increasing basis weight from the top surface to the bottom surface of the fiber web. In another embodiment, a fiber web may include a step gradient in one more properties across the thickness of the fiber web. In one such embodiment, the transition in the property may occur primarily at an interface 540 between the two layers. For example, a fiber web, e.g., having a first layer including a first fiber type and a second layer including a second fiber type, may have an abrupt transition between fiber types across the interface. In other words, each of the layers of the fiber web may be relatively distinct. In other embodiments, a gradient is characterized by a type of function across the thickness of the fiber web. For example a gradient may be characterized by a sine function, a quadratic function, a periodic function, an aperiodic function, a continuous function, or a logarithmic function across the web. Other types of gradients are also possible.

In certain embodiments, a fiber web may include a gradient in one or more properties through portions of the thickness of the fiber web. In the portions of the fiber web where the gradient in the property is not present, the property may be substantially constant through that portion of the web. As described herein, in some instances a gradient in a property involves different proportions of a component (e.g., a fiber, an additive, a binder) across the thickness of a fiber web. In some embodiments, a component may be present at an amount or a concentration that is different than another portion of the fiber web. In other embodiments, a component is present in one portion of the fiber web, but is absent in another portion of the fiber web. Other configurations are also possible.

In some embodiments, a fiber web has a gradient in one or more properties in two or more regions of the fiber web. For example, a fiber web having three layers may have a first gradient in one property across the first and second layer, and a second gradient in another property across the second and third layers. The first and second gradients may be different in some embodiments (e.g., characterized by a different function across the thickness of the fiber web), or may be the same in other embodiments. Other configurations are also possible.

A fiber web may include any suitable number of layers, e.g., at least 2, 3, 4, 5, 6, 7, 8, or 9 layers, or may be formed using any suitable number of fiber mixtures, e.g., at least 2, 3, 4, 5, 6, 7, 8, or 9 fiber mixtures, depending on the particular application and performance characteristics desired. It should be appreciated that in some embodiments, the layers forming a fiber web may be indistinguishable from one another across the thickness of the fiber web. As such, a fiber web formed from, for example, two "layers" or two "fiber mixtures" can also be characterized as having a single "layer" having a gradient in a property across the fiber web in some instances.

Examples of multi-layered fiber webs are disclosed in U.S. Patent Publication No. 2010/0116138, filed Jun. 19, 2009, entitled "Multi-Phase Filter Medium", which is incorporated herein by reference in its entirety for all purposes.

During or after formation of a fiber web, the fiber web may be further processed according to a variety of known techniques. Optionally, additional layers can be formed and/or added to a fiber web using processes such as lamination, co-pleating, or collation. For example, in some cases, two layers are formed into a composite article by a wet laid process as described above, and the composite article is then combined with a third layer by any suitable process (e.g., lamination, co-pleating, or collation). It can be appreciated that a fiber web or a composite article formed by the processes described herein may be suitably tailored not only based on the components of each fiber layer, but also according to the effect of using multiple fiber layers of varying properties in appropriate combination to form fiber webs having the characteristics described herein.

In some embodiments, further processing may involve pleating the fiber web. For instance, two layers may be joined by a co-pleating process. In some cases, the fiber web, or various layers thereof, may be suitably pleated by forming score lines at appropriately spaced distances apart from one another, allowing the fiber web to be folded. It should be appreciated that any suitable pleating technique may be used.

It should be appreciated that the fiber web may include other parts in addition to the one or more layers described herein. In some embodiments, further processing includes incorporation of one or more structural features and/or stiffening elements. For instance, the fiber web may be combined with additional structural features such as polymeric and/or metallic meshes. In one embodiment, a screen backing may be disposed on the fiber web, providing for further stiffness. In some cases, a screen backing may aid in retaining the pleated configuration. For example, a screen backing may be an expanded metal wire or an extruded plastic mesh.

In some embodiments, fiber webs used as filter media can be incorporated into a variety of filter elements for use in various filtering applications. Exemplary types of filters include hydraulic mobile filters, hydraulic industrial filters, fuel filters (e.g., automotive fuel filters), oil filters (e.g., lube oil filters or heavy duty lube oil filters), chemical processing filters, industrial processing filters, medical filters (e.g., filters for blood), air filters, and water filters. In some cases, filter media described herein can be used as coalescer filter media. The filter media may be suitable for filtering gases or liquids.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method of forming a fiber web, comprising:

introducing a first fiber mixture and a second fiber mixture into a flow zone of a system for forming a fiber web;

flowing the first fiber mixture in a lower portion of the flow zone;

flowing the second fiber mixture in an upper portion of the flow zone, wherein the lower and upper portions of the flow zone are separated by a lamella;

disrupting laminar flow of a fiber mixture in the lower portion or upper portion of the flow zone using a flow impediment positioned in the lower portion or upper portion of the flow zone, respectively;

collecting fibers from the first and second fiber mixtures in a fiber web forming zone; and forming a fiber web comprising fibers from the first and second fiber mixtures, wherein the fiber web comprises a gradient in at least one of fiber diameter, fiber type, fiber composition, fiber length, pore size, material density, basis weight, solidity, a proportion of a component, hydrophilicity/hydrophobicity, and conductivity across a portion, or all, of a thickness of the fiber web.

2. The method of claim 1, wherein the lamella positioned in the flow zone and separating the flow zone into a lower portion and an upper portion is a primary lamella, wherein the flow impediment is a secondary lamella, and wherein the secondary lamella is positioned in one of the lower and upper portions of the flow zone and positioned to divide portions of the first fiber mixture, or portions of the second fiber mixture, in the flow zone.

3. The method of claim 2, wherein the primary lamella and/or secondary lamella is connected to a control system to control the height of the primary and/or secondary lamella in the flow zone.

4. The method of claim 3, wherein the control system is an electromechanical control system.

5. The method of claim 2, comprising changing the height of the primary and/or secondary lamella within the flow zone.

6. The method of claim 2, comprising changing the height of the primary and/or secondary lamella within the flow zone while the first and second fiber mixtures are flowing in the flow zone.

7. The method of claim 2, comprising introducing a third fiber mixture into the flow zone, the system comprising a third lamella that separates the flow zone into three portions, the third lamella positioned to divide the third fiber mixture from the first and/or second fiber mixtures in the flow zone.

8. The method of claim 1, wherein the flow impediment is a disruptive member.

9. The method of claim 8, wherein the disruptive member comprises one or more openings.

10. The method of claim 8, wherein the disruptive member is a circular roll or a wheel.

11. The method of claim 10, comprising a motor connected to the disruptive member for controlling a rotational rate of the disruptive member.

12. The method of claim 8, comprising flowing the first or second fiber mixtures past the disruptive member and causing the disruptive member to rotate at least in part by the flow of the fiber mixtures.

13. The method of claim 8, comprising controlling a rotational rate of the disruptive member at least in part using a motor.

14. The method of claim 8, comprising changing the position and/or configuration of the disruptive member within the flow zone while the first and second fiber mixtures are flowing in the flow zone.

15. The method of claim 1, wherein the lamella positioned in the flow zone and separating the flow zone into a lower portion and an upper portion is a primary lamella, and wherein the flow impediment comprises a textured surface portion comprising a plurality of surface features associated with the primary lamella.

16. The method of claim 15, wherein the textured surface portion comprises a plurality of protrusions.

17. The method of claim 15, wherein the textured surface portion comprises a plurality of indentations.

18. The method of claim 15, wherein the plurality of features have a height or a depth of at least 5 mm.

19. The method of claim 15, wherein the plurality of features have a lateral dimension of at least 5 mm.

20. The method of claim 15, wherein both of the top and bottom surfaces of the lamella comprises a textured surface portion.

21. The method of claim 15, wherein at least 20% of the area of the top or bottom surface of the lamella comprises a textured surface portion.

22. The method of claim 1, wherein the lamella positioned in the flow zone and separating the flow zone into a lower portion and an upper portion is a primary lamella, and wherein the flow impediment comprises a variable volume member associated with the primary lamella.

23. The method of claim 22, wherein the variable volume member contains a liquid.

24. The method of claim 22, wherein the variable volume member contains a gas.

25. The method of claim 22, comprising changing the volume of the variable volume member by at least 2 times upon expansion or contraction.

26. The method of claim 22, comprising changing the volume of the variable volume member while the first and second fiber mixtures are flowing in the flow zone.

27. The method of claim 22, comprising changing the volume of the variable volume member at a frequency of at least 10 cycles/min.

28. The method of claim 22, wherein the variable volume member is expanded in the upper portion of the flow zone.

29. The method of claim 22, wherein the variable volume member is expanded in the lower portion of the flow zone.

30. The method of claim 22, wherein the variable volume member is expanded to have a volume of greater than about 10 $cm^3$.

31. The method of claim 22, wherein the flow impediment creates intermixing of the first and second fiber mixtures at a fiber web forming zone.

32. The method of claim 1, wherein the first fiber mixture comprises a plurality of first fibers and the second fiber mixture comprises a plurality of second fibers, and wherein the first and second fibers are the same.

33. The method of claim 1, wherein the first fiber mixture comprises a plurality of first fibers and the second fiber mixture comprises a plurality of second fibers, and wherein the first and second fibers are different.

34. The method of claim 1, comprising forming a fiber web comprising a gradient in at least one of efficiency, dust holding capacity, pressure drop, air permeability, and porosity across a portion, or all, of a thickness of the fiber web.

35. The method of claim 1, wherein disrupting laminar flow creates intermixing of the first and second fiber mixtures at a fiber web forming zone.

36. A method as in claim 1, wherein the fiber web comprises a gradient in at least one of fiber diameter, fiber type, fiber composition, fiber length, pore size, and solidity across a portion, or all, of a thickness of the fiber web.

37. A method of forming a fiber web, comprising:

introducing a first fiber mixture and a second fiber mixture into a flow zone of a system for forming a fiber web;

flowing the first fiber mixture in a lower portion of the flow zone;

flowing the second fiber mixture in an upper portion of the flow zone, wherein the lower and upper portions of the flow zone are separated by a primary lamella;

disrupting laminar flow of a fiber mixture in the lower portion or upper portion of the flow zone using a flow impediment positioned in the lower portion or upper portion of the flow zone, respectively, wherein the flow impediment is a secondary lamella, and wherein the secondary lamella is positioned to divide portions of the first fiber mixture, or portions of the second fiber mixture, respectively, in the flow zone;

collecting fibers from the first and second fiber mixtures in a fiber web forming zone; and forming a fiber web comprising fibers from the first and second fiber mixtures.

38. A method of forming a fiber web, comprising:

introducing a first fiber mixture and a second fiber mixture into a flow zone of a system for forming a fiber web;

flowing the first fiber mixture in a lower portion of the flow zone;

flowing the second fiber mixture in an upper portion of the flow zone, wherein the lower and upper portions of the flow zone are separated by a lamella;

disrupting laminar flow of a fiber mixture in the lower portion or upper portion of the flow zone using a flow impediment positioned in the lower portion or upper portion of the flow zone, respectively, wherein the flow impediment comprises a variable volume member associated with the lamella;

collecting fibers from the first and second fiber mixtures in a fiber web forming zone; and forming a fiber web comprising fibers from the first and second fiber mixtures.

39. A method of forming a fiber web, comprising:

introducing a first fiber mixture and a second fiber mixture into a flow zone of a system for forming a fiber web;

flowing the first fiber mixture in a lower portion of the flow zone;

flowing the second fiber mixture in an upper portion of the flow zone, wherein the lower and upper portions of the flow zone are separated by a lamella;

disrupting laminar flow of a fiber mixture in the lower portion or upper portion of the flow zone using a flow impediment positioned in the lower portion or upper portion of the flow zone, respectively;

collecting fibers from the first and second fiber mixtures in a fiber web forming zone; and forming a fiber web comprising fibers from the first and second fiber mixtures, wherein the fiber web comprising a gradient in at least one of efficiency, dust holding capacity, pressure drop, air permeability, and porosity across a portion, or all, of a thickness of the fiber web.

40. A method of forming a fiber web, comprising:

introducing a first fiber mixture and a second fiber mixture into a flow zone of a system for forming a fiber web;

flowing the first fiber mixture in a lower portion of the flow zone;

flowing the second fiber mixture in an upper portion of the flow zone, wherein the lower and upper portions of the flow zone are separated by a lamella;

disrupting laminar flow of a fiber mixture in the lower portion or upper portion of the flow zone using a flow impediment positioned in the lower portion or upper portion of the flow zone, respectively, wherein the flow impediment is a disruptive member, and wherein the disruptive member comprises one or more openings;

collecting fibers from the first and second fiber mixtures in a fiber web forming zone; and forming a fiber web comprising fibers from the first and second fiber mixtures.

* * * * *